US009211964B1

(12) United States Patent
Villines

(10) Patent No.: US 9,211,964 B1
(45) Date of Patent: Dec. 15, 2015

(54) UNLOADING SYSTEM

(71) Applicant: Iron Horse Industries, LLC, Weatherford, OK (US)

(72) Inventor: Benjamin K. Villines, Weatherford, OK (US)

(73) Assignee: Iron Horse Industries, LLC, Weatherford, OK (US)

( * ) Notice: Subject to any disclaimer, the term of this patent is extended or adjusted under 35 U.S.C. 154(b) by 255 days.

(21) Appl. No.: 14/100,348

(22) Filed: Dec. 9, 2013

(51) Int. Cl.
*B23P 19/04* (2006.01)
*B65B 69/00* (2006.01)

(52) U.S. Cl.
CPC ..... *B65B 69/00* (2013.01)

(58) Field of Classification Search
USPC ..... 29/244, 253, 255, 256
See application file for complete search history.

(56) References Cited

U.S. PATENT DOCUMENTS 2,809,059 A * 10/1957 Hillis ..... F16K 41/02 137/315.27
4,841,620 A * 6/1989 Kadlub ..... B25B 27/0028 277/511
5,107,882 A * 4/1992 Carroll ..... F16K 27/02 137/315.28
5,127,145 A * 7/1992 Ross ..... B25B 27/0028 29/235

* cited by examiner

*Primary Examiner* — Lee D Wilson
*Assistant Examiner* — Shantese McDonald
(74) *Attorney, Agent, or Firm* — Gary Peterson

(57) ABSTRACT

An unloading system for a stuffing box includes a plate-like footing element within which a stuffing box may be locked. An unloading tool includes concentric inner and outer shafts. A grip element formed at the end of the outer shaft includes a segmented wing section arrayed radially about the tool axis. An enlarged core element is formed at the end of the inner shaft. Relative longitudinal movement of the inner and outer shafts allows the core element to expand or contract the wing section's cross-sectional profile. The unloading tool is actuated within the stuffing box to enlarge the cross-sectional profile of the wing section, which tightly grips the internal walls of the base packing element. Axial force applied to the outer shaft from an elevated platform withdraws the outer shaft from the stuffing box. The gripped base packing element, and the packing elements above it, are concurrently unloaded.

31 Claims, 21 Drawing Sheets

FIG. 19
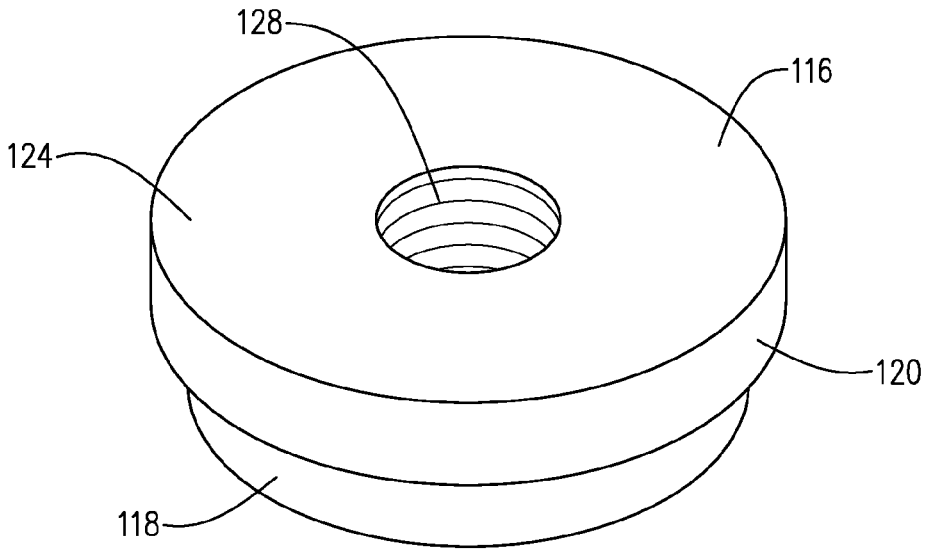
FIG. 19
FIG. 18
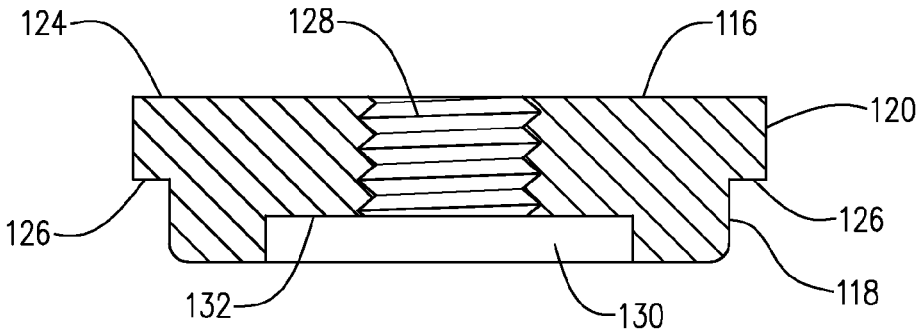
FIG. 18

UNLOADING SYSTEM

SUMMARY OF THE INVENTION

A kit is provided for unloading a stuffing box that has been loaded with stacked annular packing elements. The packing elements include a lowermost base retainer element having internal walls. The kit is formed from a footing element and one or more components that can form an unloading tool. The footing element is adapted to releasably engage and maintain the stuffing box in a fixed position. The unloading tool is adapted to engage the internal walls of the loaded base retainer element. Forming the unloading tool are an elongate shaft and a grip element. The grip element is positionable at one end of the shaft and features a wing section with a cross-sectional profile that can be selectively contracted and expanded.

An assembly is formed from a stuffing box, a footing element and an unloading tool. The stuffing box is loaded with stacked annular packing elements, including a lowermost base retainer element having internal walls. The stacked packing elements define an internal channel. The footing element releasably engages and maintains the stuffing box in a fixed position. The unloading tool is adapted to engage the internal walls of the loaded base retainer element. Forming the unloading tool are an elongate shaft and a grip element. The shaft extends within the channel defined by the stacked packing elements. The grip element is positioned at one end of the shaft and features a wing section with a cross-sectional profile that can be selectively contracted and expanded.

BRIEF DESCRIPTION OF THE DRAWINGS

FIG. 9 is a side elevation view showing a loaded stuffing box installed in the recessed receptacle of a footing element. The hidden boundaries of the recessed receptacle and its internal apertures are shown in dashed lines.

FIG. 18 is a perspective view of a plug element.

FIG. 19 is a cross-sectional view of the plug element shown in FIG. 18.

FIG. 29 is a perspective view showing an loading shaft installed in the recessed receptacle of a footing element.

FIG. 31 is a perspective view of the stuffing box of FIG. 30 at a later stage of the loading process. A nut installed on the loading shaft has been tightened to press the insertion element, and the packing elements below it, into the stuffing box.

DETAILED DESCRIPTION

Figure 1:
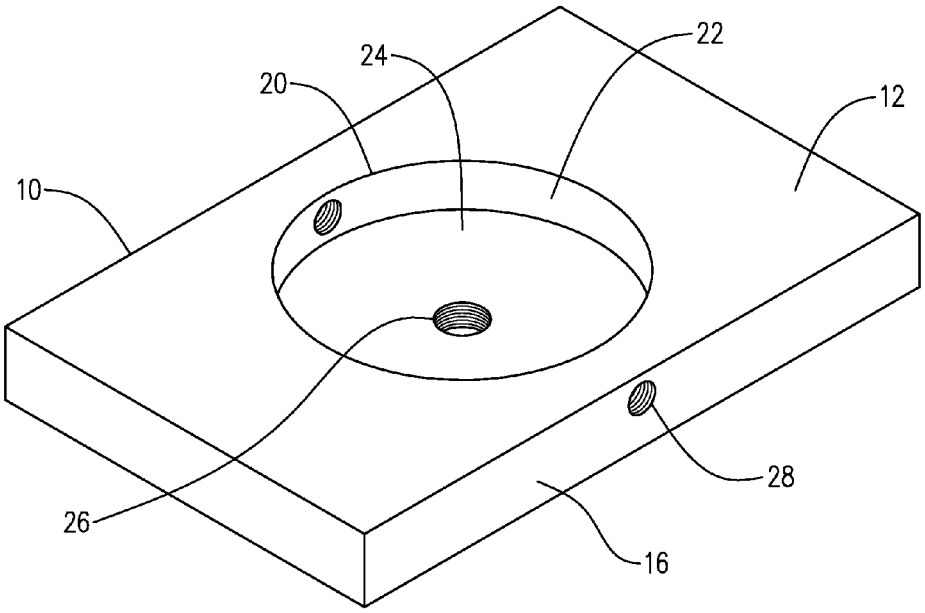
FIG. 1 is a perspective view of a footing element.
Figure 2:
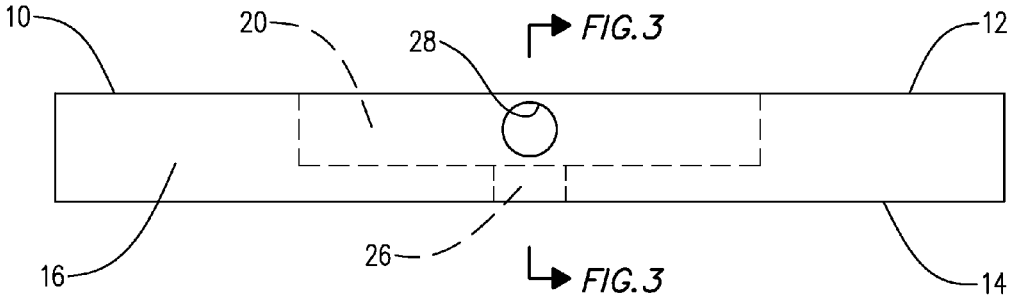
FIG. 2 is a front elevation view of the footing element shown in FIG. 1. The hidden boundaries of the recessed receptacle and its internal apertures are shown in dashed lines.
Figure 3:
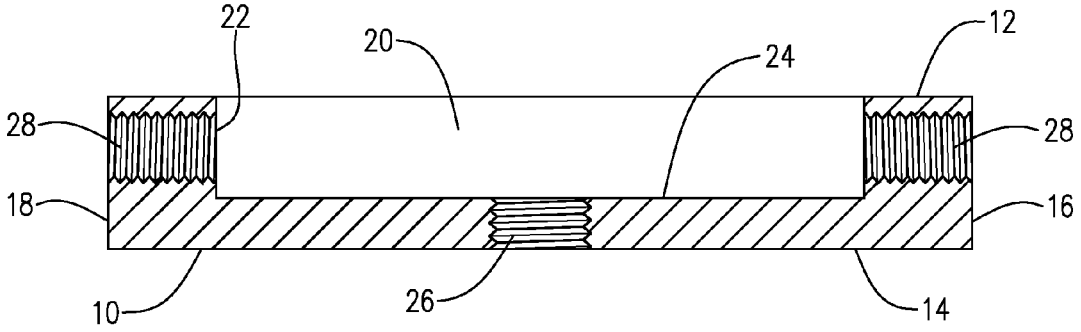
FIG. 3 is a cross-sectional view of the footing element shown in FIG. 2.

FIGS. 1-26 illustrate the construction and use of an unloading system for a stuffing box. The system includes the footing element 10 shown in FIGS. 1-3. The footing element 10 is a solid plate-like member formed from a strong and durable material. Preferably, the footing element 10 is shaped as a right rectangular prism, and is characterized by opposed planar external upper and lower surfaces 12 and 14, and opposed planar external side walls 16 and 18.

A recessed receptacle 20 is formed in an interior portion of the upper surface 12 of the footing element 10. The receptacle is characterized by an internal side wall or walls 22, and a planar base 24 disposed in parallel relationship to the upper and lower surfaces 12 and 14.

The receptacle 20 should be sized and shaped to conform to the external contour of the lower portion of a stuffing box with which the unloading system is to be used. The receptacle 20 closely but clearingly receives the external flange of such a stuffing box. In the embodiment shown in the Figures, the receptacle 20 has internal side walls 22 and a base 24 that define a cylindrical shape. An internally threaded rectilinear shaft socket 26 is formed in the base 24 of the receptacle 20. The shaft socket 26 is disposed in coaxial relationship with the receptacle 20.

Figure 4:
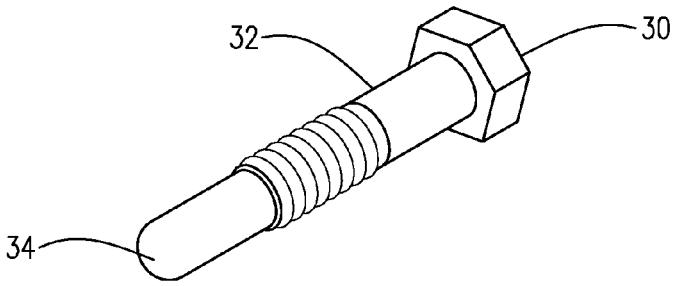
FIG. 4 is a perspective view of a fastener used to lock a stuffing box within the recessed receptacle of a footing element.
Figure 5:
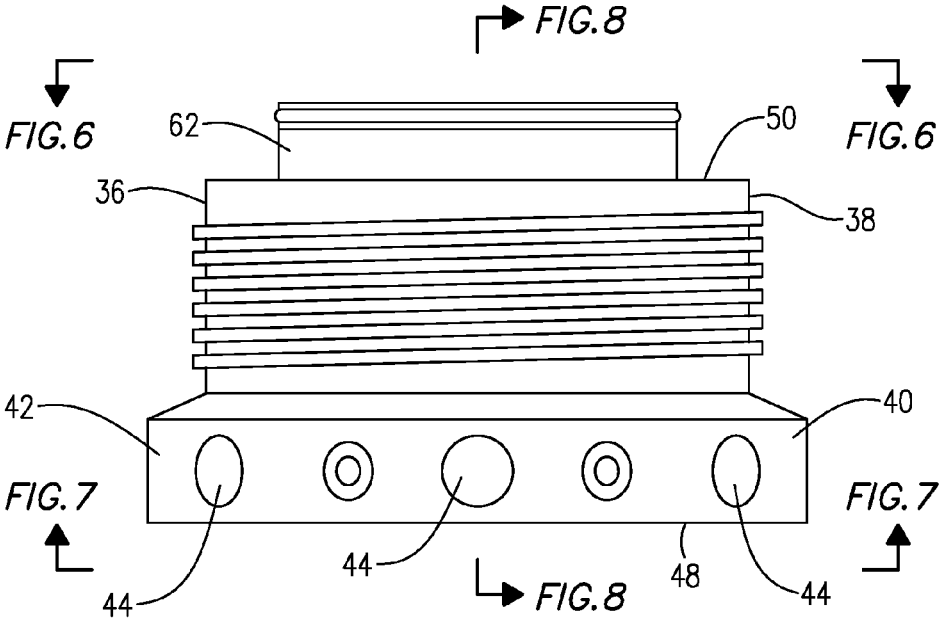
FIG. 5 is a front elevation view of a loaded stuffing box.
Figure 6:
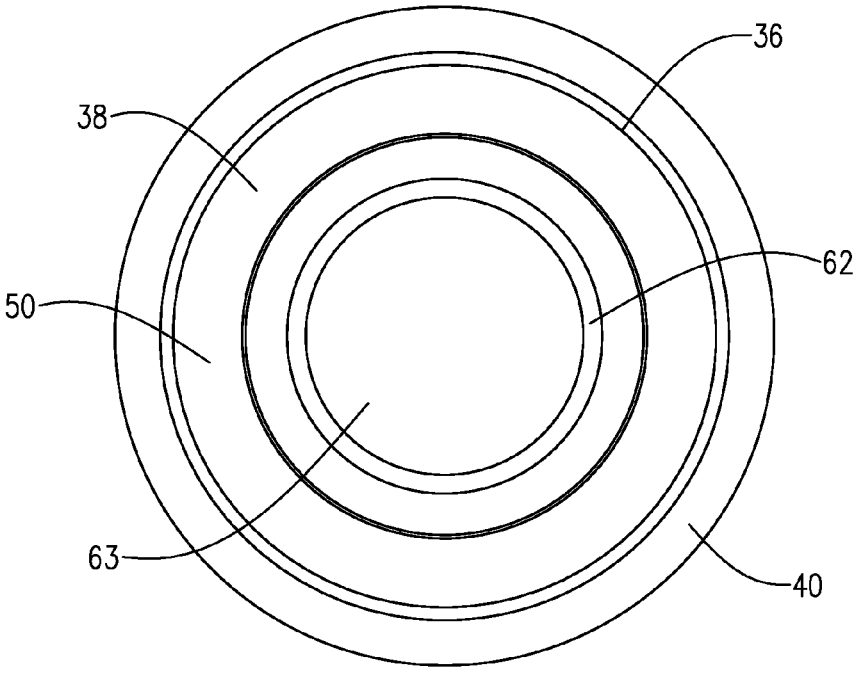
FIG. 6 is a top plan view of the stuffing box shown in FIG. 5.
Figure 7:
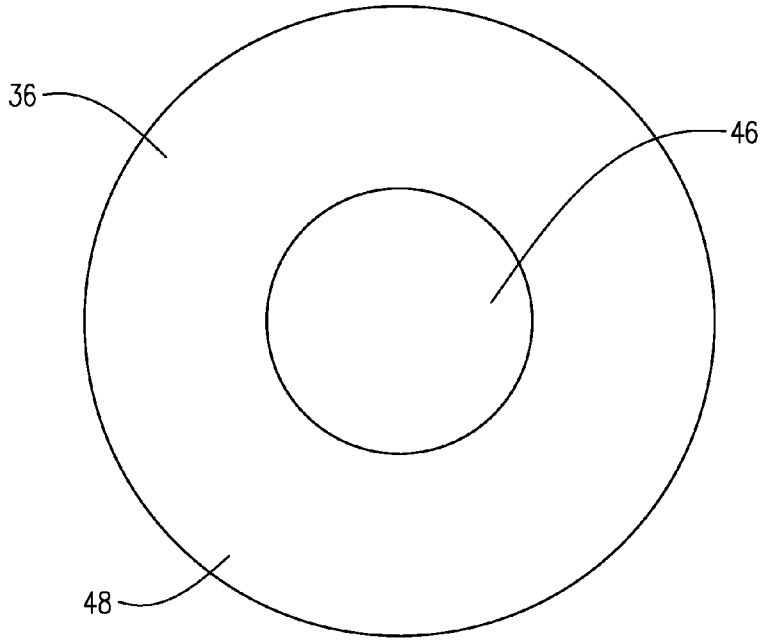
FIG. 7 is a bottom plan view of the stuffing box shown in FIG. 5.

The footing element 10 preferably includes a locking system 27 that is adapted to restrain a stuffing box within receptacle 20. Forming the locking system 27 are at least one, and preferably a plurality of releasable fasteners, such as bolts 30. One such bolt is shown in FIG. 4. The shaft 32 of bolt 30 is partially threaded along its length, and includes an unthreaded and rounded end portion 34.

The locking system 27 further comprises at least one, and preferably a plurality of internally threaded rectilinear anchor sockets 28 formed in one or more side walls of the footing element 10. In the embodiment shown in the Figures, a pair of aligned anchor sockets 28 are respectively formed in the side walls 16 and 18. Opposite its associated side wall, each of the anchor sockets 28 penetrates a side wall 22 and opens into the receptacle 20. Preferably, the anchor sockets 28 are formed as aligned pairs.

The shaft 32 of each bolt 30 is sized to be closely but clearingly received within an anchor socket 28, with the external threads of bolt 30 mating with the internal threads of anchor socket 28. As the bolt 30 is threaded into an anchor socket 28, the end portion 34 of its shaft 32 enters the receptacle 20 and may engage and restrain any stuffing box situated in the receptacle 20.

Because of the mating threads within the anchor socket 28, the position of the bolt 30, and thus its engagement with any stuffing box, may be adjusted by turning. Any stuffing box that is engaged and restrained by a bolt 30 may be released by turning the bolt in anchor socket 28 until the end portion 34 disengages the stuffing box. The bolts 30 should be provided in a number that matches the number of anchor sockets 28.

In one embodiment, the footing element 10 is formed from 6061-T6 aluminum alloy. The height of the footing element is 1.5 inches and its rectangular side dimensions are 13.125 inches and 8.5 inches. The receptacle 20 is cylindrical in shape, with a diameter of 6.420 inches and a depth of 1 inch. The center of each of the side apertures is situated 0.5 inch below the upper surface 12. The bolts 30 are 0.75 inch hex head grade 8 bolts with a 3-inch length. The unthreaded end portion of each bolt has a length of 1 inch and a diameter of 0.615 inch.

FIGS. 5-8 show a loaded stuffing box 36 with which the footing element 10 is to be used. The stuffing box 36 is a removable component of a high-flow, high-volume pump, such as the Kerr KA-3500 triplex plunger pump. Pumps of this type are often used to power flow of high volumes of drilling mud and other fluids used in oilfield operations.

During operation of a pump, reciprocation of the rod assembly causes the seals within the stuffing box 36 to wear. In order to keep the pump operating efficiently, these seals must be periodically replaced. However, removal of these worn seals from a stuffing box can be a difficult and time-consuming operation. Under outdoor field conditions, water may cause seals within the box to expand, tightening their fit within the box.

When seal replacement is attempted with conventional hand tools, these tools can easily scratch or otherwise damage the inner surfaces of the stuffing box. Such damage can interfere with efficient pump operation. Moreover, with conventional hand tools, it may be quite difficult to overcome the frictional forces between the box and its tightly packed contents. Seal replacement using such tools can sometime take hours. Because critical pump operations must cease while seal replacement is going on, the economic costs of prolonged seal replacement can be enormous. Entire crews of workers may be sidelined for hours merely because the tightly lodged worn seals in a single small stuffing box cannot be promptly extracted.

As shown in FIGS. 5-8, the stuffing box 36 is a tubular structure having a body 38 positioned above an enlarged external flange 40. Formed peripherally about the external surface 42 of the flange 40 are a series of shallow openings 44 where the flange 40 may be gripped. A smooth, cylindrically-shaped internal bore 46 extends the length of the stuffing box 36, from the base 48 of flange 40 to upper end 50.

Figure 8:
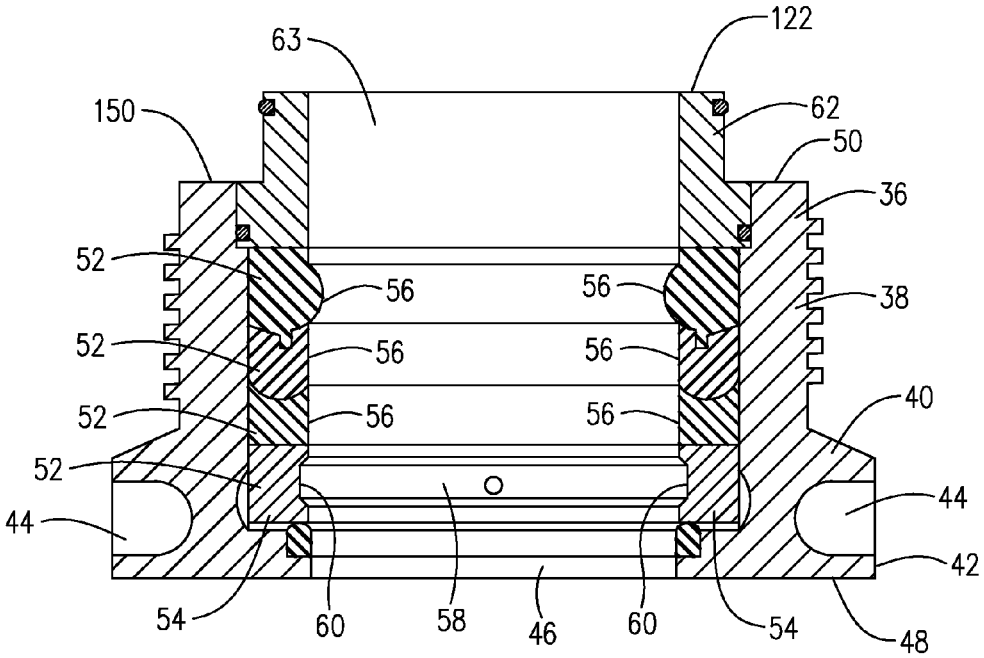
FIG. 8 is a cross-sectional view of a loaded stuffing box.
Figure 3:
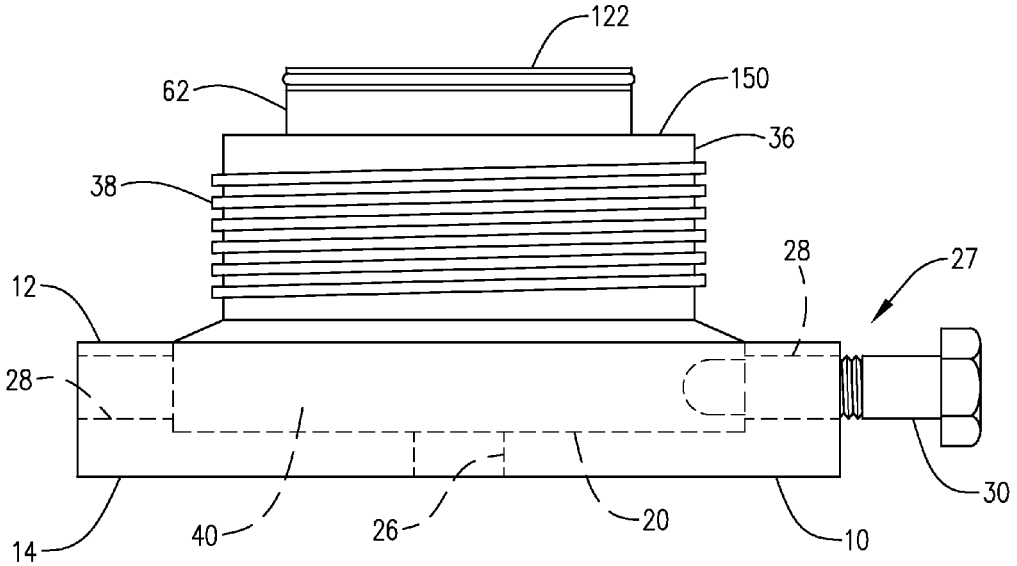

FIG. 8 shows the annular packing elements 52 used to load the stuffing box 36. These packing elements 52 include a base retainer element 54, seals 56 and a box closure element 62. These packing elements 52 are loaded into the bore 46 from the upper end 50.

The lowermost packing element 52 in the stuffing box 36 is base retainer element 52. The base retainer element 52 is loaded first into the bore 46 and is positioned nearest the base 48. The base retainer element 54 is preferably a lantern ring, and has an internal wall or walls 58 which form a recessed peripheral internal raceway 60.

Loaded next, immediately above and atop base retainer element 54, is a plurality of seals 56. Three such seals 56 are shown in the Figures. Loaded last, immediately above the seals 56, is the box closure element 62, which serves as the uppermost packing element 52. Because the stuffing box 36 is tubular and the stacked packing elements 52 are annular, the loaded packing elements 52 define a centrally disposed axial channel 63 extending the entire length of the stuffing box 36. The loaded stuffing box 36 has an upper end 65 and a lower end 67.

FIG. 9 shows a stuffing box 36 that has been positioned in the footing element 10. The stuffing box 36 has been lowered within receptacle 20 from above the upper surface 12 of the footing element 10. The flange 40 of stuffing box 36 has been closely but clearingly received in receptacle 20, such that base 48 engages the base 24 of the receptacle 20. If necessary, the stuffing box 36 should be rotated so that each of the anchor sockets 28 is aligned with an opening 44 formed in the flange 40.

A bolt 30, one of which is shown in FIG. 9, is inserted into a threaded anchor socket 28. The bolt 30 is then actuated by rotation until the end portion 34 of the shaft 32 is received within an opening 44 and fully engages the flange 40. The actuation process is repeated for each bolt 30 and its associated anchor socket 28.

After each bolt 30 has been so actuated, the stuffing box 36 is engaged and restrained within the receptacle 20. In this configuration, the footing element 10 functions to maintain the stuffing box 36 in a stable and fixed position, with a vertical longitudinal axis.

With the stuffing box 36 so restrained, the radial component of any forces applied to the packing elements 52 can be minimized. Radial force components tend to generate friction between the packing elements 52 and the walls forming the internal bore 46. Such friction can frustrate timely unloading of packing elements 52, particularly when the stuffing box 36 is tightly packed.

Figure 10:
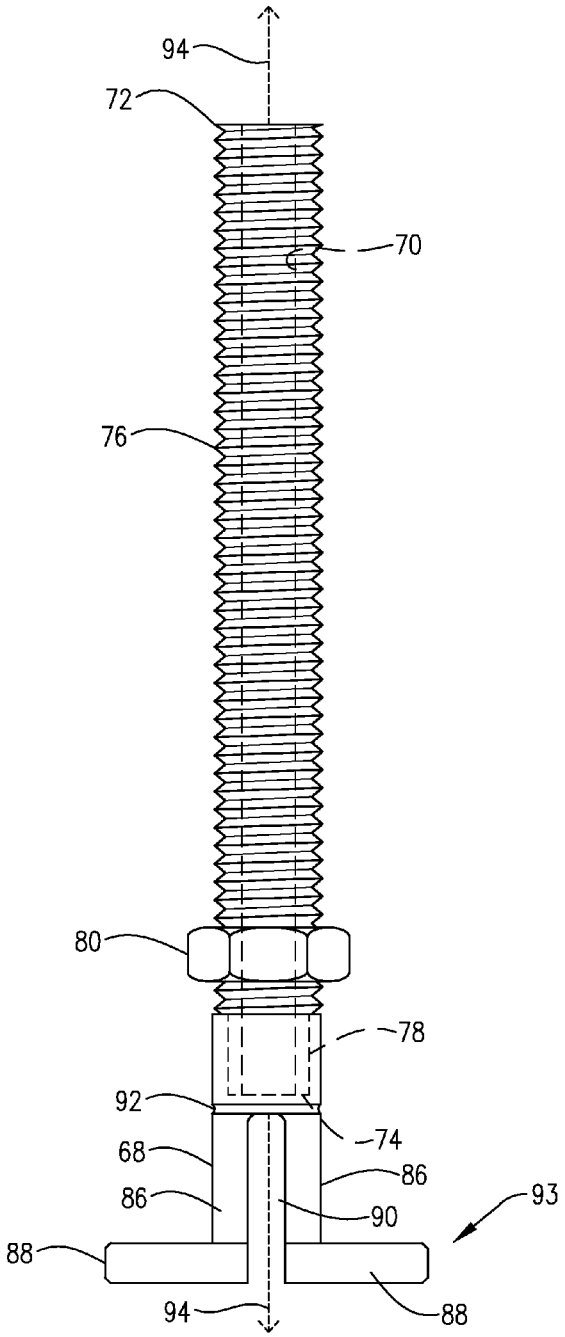
FIG. 10 is a front elevation view of the assembled outer shaft and grip element of an unloading tool.
Figure 12:
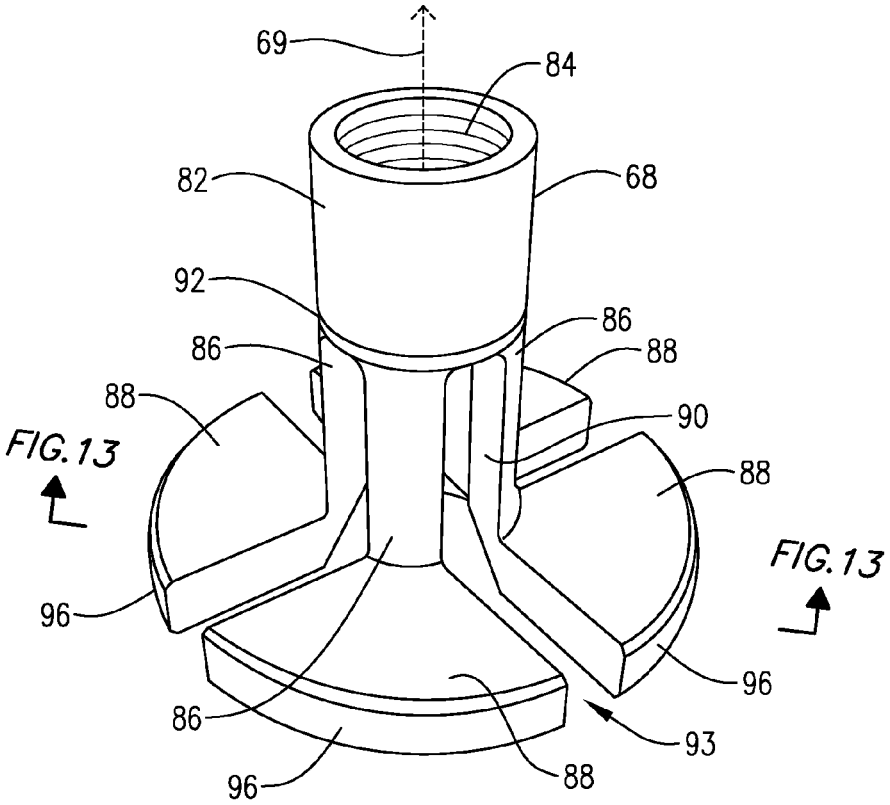
FIG. 12 is a perspective view of a grip element of an unloading tool.
Figure 13:
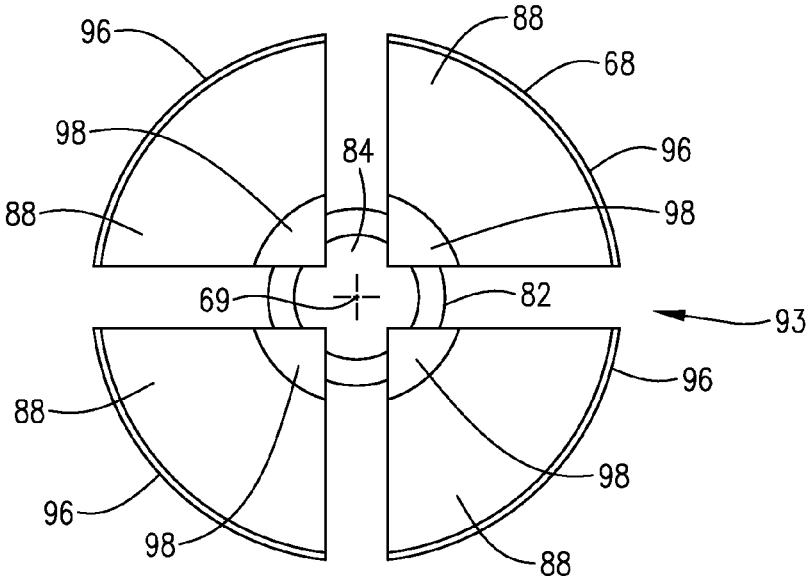
FIG. 13 is a bottom plan view of the grip element shown in FIG. 12.
Figure 14:
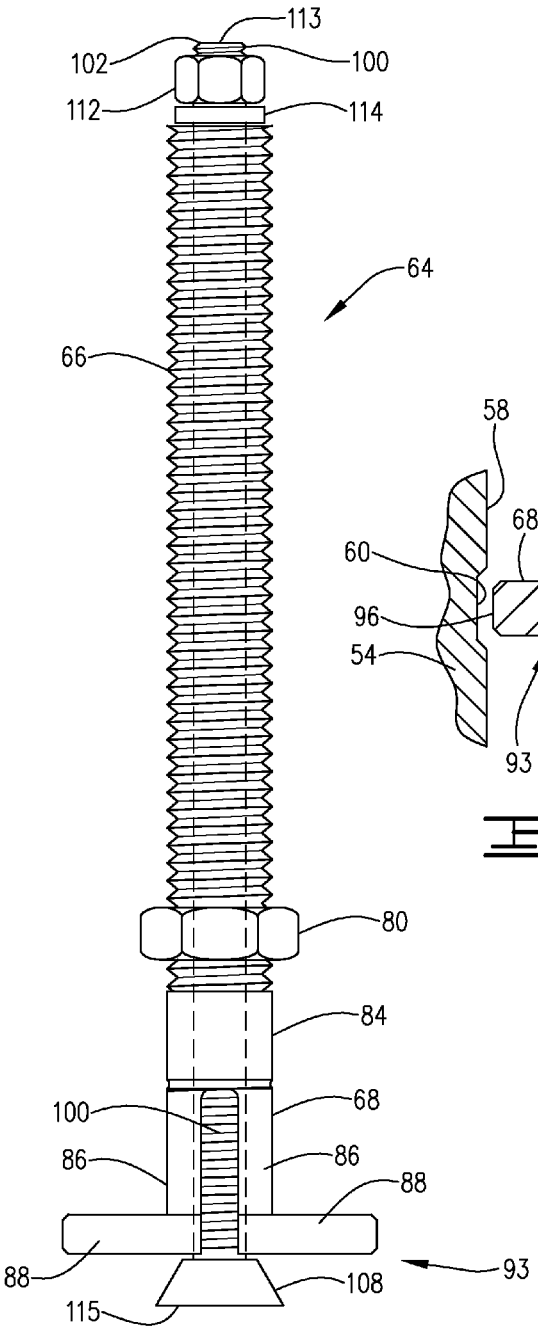
FIG. 14 is a front elevation view of a fully assembled unloading tool. Hidden portions of the inner shaft are shown in dashed lines. The inner shaft is in an extended position.
Figure 16:
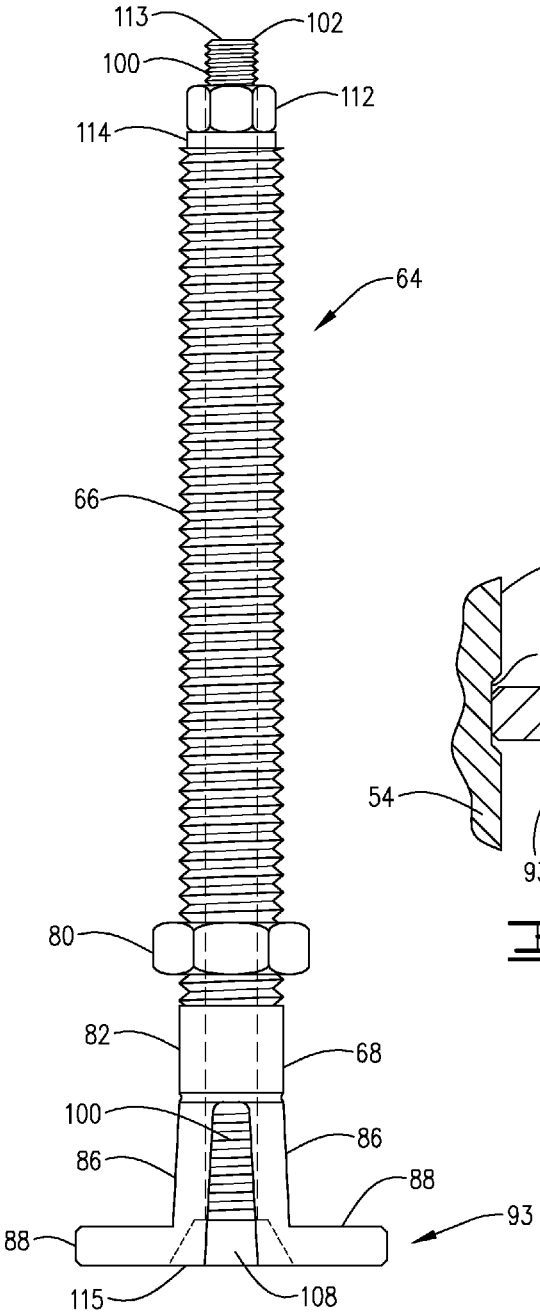
FIG. 16 is a front elevation view of the assembled unloading tool shown in FIG. 14. The inner shaft is in a fully retracted position.

FIGS. 14 and 16 show an assembled unloading tool 64, while FIGS. 10-13 illustrate components of that tool. Shown in FIG. 10 are an assembled outer shaft 66 and grip element 68. The outer shaft 66 is an elongate hollow member, preferably having a circular cross-sectional profile. A smooth axially-extending internal bore 70 is formed within the outer shaft 66 and extends along its entire length. The internal bore 70 should be of sufficient size to axially receive the inner shaft 100 to be described hereafter.

Preferably, the outer shaft 66 is characterized by a first end 72 and an opposed second end 74 and is symmetrical about a longitudinal axis 94. An upper section 76 terminates at the free first end 72. An adjacent lower section 78 terminates at the free second end 74. The upper section 76 has a first diameter, while the lower section 78 has a second diameter smaller than the first diameter. External threads are preferably formed along the entire lengths of the upper and lower sections 76 and 78.

A stop element 80 having an enlarged cross-sectional profile is externally formed on the upper section 76 of the outer shaft 66. Preferably, the stop element 80 comprises a nut having internal threads that mate with the external threads formed on the upper section 76. The stop element 80 is held in a fixed position on the outer shaft 66, either by an adhesive or more preferably by a set screw. As will be described later in more detail, the fixed position of the stop element 80 is chosen so that, when the unloading tool 64 is installed within the stuffing box 36, the wing section 93 of the grip element 68 is maintained within base retainer element 54.

In one embodiment, the outer shaft 66 is formed from a cylindrical steel bar. The bar is drilled axially to form a smooth internal bore 70 having a diameter of 0.5 inches. Upper section 76 has a length of 8.25 inches, a diameter of 1 inch, and is provided with an Acme thread. Lower section 78 has a length of 0.75 inches, a diameter of 0.75 inches and 16 threads per inch of length. The thickness of the nut that forms stop element 80 is 0.5 inches.

With reference to FIGS. 12 and 13, the grip element 68 is symmetric about a longitudinal axis 69, and is formed from a collar section 82 that is linked by legs 86 to a wing section 93. The collar section 82 is a hollow member having a circular cross-sectional profile. Extending axially through the collar section 82 is an internal bore 84 of sufficient size to axially receive the inner shaft 100 to be described hereafter.

The walls forming the internal bore 84 are provided with threads that can mate with the external threads formed in the lower section 78 of the outer shaft 66. When the outer shaft 66 and grip element 68 are assembled, the upper end of collar section 82 should abut the lower end of upper section 76 of the outer shaft 66, as shown in FIG. 10.

Depending from the collar section 82 are a plurality of spaced-apart legs 86, each of which terminates in a radially-projecting wedge member 88. Adjacent legs 86 are separated by elongate slots 90. To strengthen the grip element 68 and enhance its flexibility, a circumferential stress relief groove 92 may be formed at the base of collar section 82 adjacent its junction with legs 86.

The wedge members 88 collectively form a wing section 93 having a cross-sectional profile that can be selectively contracted and expanded. The wedge members 88 are identically shaped and sized, uniformly spaced, and arrayed symmetrically around the longitudinal axis 94 of grip element the unloading tool 64, as shown in FIG. 10. Each wedge member 88 has planar upper and lower surfaces and is shaped much like a slice of pie.

Each wedge member 88 has an outer side surface 96 that is conformably engageable with the internal walls 58 of the base retainer element 54, and a tapered inner side surface 98. The distance of inner side surface 98 from axis 94 increases as the distance from the collar section 82 increases. The included angle between the inner side surface 98 and axis 94 is preferably between about 25 and about 35 degrees, and is more preferably 30 degrees.

In the embodiment shown in the Figures, the grip element 68 is provided with four legs 86 and four wedge members 88. The legs 86 are aligned with, and extend within, the cross-sectional profile of the collar section 82. The wedge members 88, on the other hand, have an enlarged cross-section profile relative to that of the collar section 82.

The grip element 68 should be formed from a strong, durable and resilient material, such as spring steel. Preferably, the grip element 68 is formed from a single, homogeneous piece of material.

In one embodiment, the grip element 68 is formed from 4140 spring steel. The overall height of the grip element 68 is 2.5 inches. The thickness of each wedge member 88 is 0.375 inches. The maximum width of the grip element 68 is 2.980 inches. The diameter of the collar section 82 is 1 inch.

Figure 11:
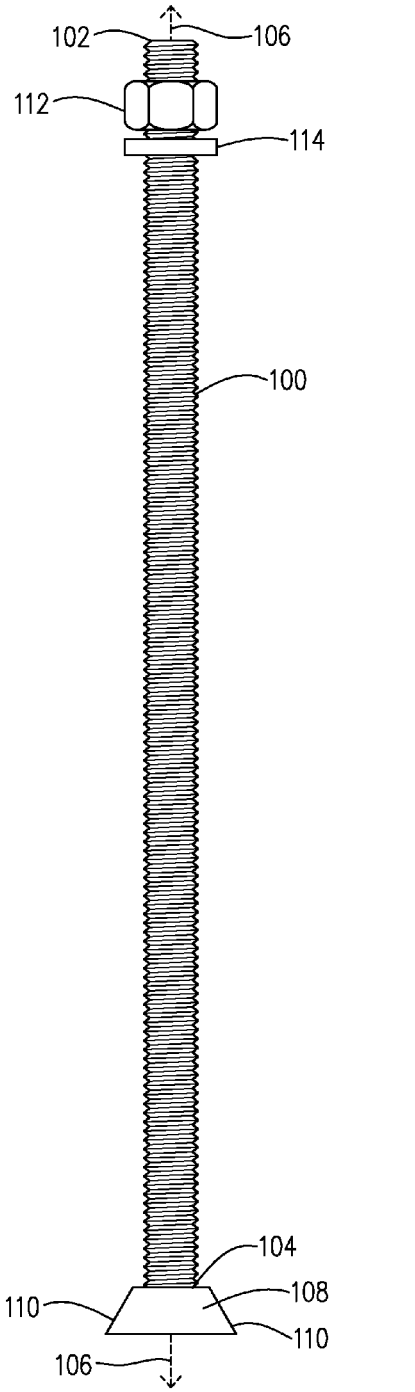
FIG. 11 is a front elevation view of the assembled inner shaft and core element of an unloading tool.

FIG. 11 shows an elongate inner shaft 100 having a first end 102 and an opposed second end 104. The inner shaft 100 is symmetrical about a longitudinal axis 106. The length of the inner shaft 100 should exceed that of the outer shaft 66. The inner shaft 100 is sized to be axially receivable through the internal bore 70 of outer shaft 66 and through the internal bore 84 of collar section 82. Preferably, the inner shaft 100 is threaded along its entire length.

Formed at the second end 104 of the inner shaft 100 is an enlarged core element 108 disposed in coaxial relationship to the inner shaft 100 along axis 106. The core element 108 has at least one tapered outer side surface 110 that can slidingly engage the tapered inner side surfaces 98 of the wedge members 88 forming the wing section 93. The distance of outer side surfaces 110 from the axis of inner shaft 100 increases as the distance from the second end 104 increases.

In the embodiment shown in the Figures, the anvil-shaped core element 108 is an axially symmetric solid member shaped as a right conical frustum. The core element 108 is enclosed by a single continuous outer side surface 110. The included angle between the outer side surface 110 and axis 106 is preferably between about 145 and about 155 degrees, and is more preferably 150 degrees.

The core element 108 should be permanently attached to the second end of inner shaft 100. To form such an attachment, the threaded second end 104 of the inner shaft 100 may be engaged with a mating threaded hole formed in the upper surface of the core element 108. An adhesive such as Loctite may applied to threads to secure to maintain the mating components in fixed relation.

An internally threaded nut 112 has an enlarged cross-sectional profile relative to the inner shaft 100. The nut 112 may be threaded onto the first end 102 of the inner shaft 100, and positioned longitudinally by rotation. In one embodiment, the nut 112 is formed as a wing nut.

An annular washer 114, also having an enlarged cross-sectional profile, may be positioned underneath the nut 112. The washer 114 should have a maximum cross-sectional dimension that exceeds that of the bore 70 of the outer shaft 66.

In one embodiment, the inner shaft 100 is formed from a cylindrical steel bar having a diameter of 0.5 inches and 13 threads per inch of length. The tapering core element 108 is formed from polished 4140 steel, and has a circular cross-sectional profile with a maximum diameter at its base of 1.21 inches. The height of the core element 108 is 0.41 inches. The overall length of the assembled inner shaft 100 and core element 108 is 12 inches.

The unloading tool 64 is assembled by threading the collar section 82 of grip element 68 to the mating threads in the lower section 78 of outer shaft 66. This threading operation forms a single piece from the grip element 68 and the outer shaft 66. In this assembled configuration, the longitudinal axis 69 of grip element 68 coincides with the longitudinal axis 94 of outer shaft 66.

The inner shaft 100 is next prepared for assembly by removing the nut 112 and washer 114 from the first end 102 of the inner shaft 100. The first end 102 of the inner shaft 100 is then inserted coaxially between the wedge members 88, through the bore 84 of collar section 82 and through the bore 70 of outer shaft 66. Insertion continues until the first end 102 of inner shaft 100 projects out of the first end 72 of the outer shaft 66.

The washer 114, followed by the nut 112 are then installed on the projecting first end 102 of inner shaft 100. The resulting assembly is shown in FIG. 14. The assembled unloading tool 64 has an upper end 113, situated adjacent the first ends 72 and 102 of the shafts 66 and 100, and a lower end 115, situated adjacent the grip and core elements 68 and 108.

Positioning of nut 112 adjusts the relative longitudinal positioning of the inner and outer shafts 100 and 66, so that the inner shaft 100 is longitudinally movable relative to the outer shaft 66. Because core element 108 and wedge members 88 are respectively supported by the inner and outer shafts 100 and 166, positioning of nut 112 also controls the relative longitudinal positioning of the core element 108 and wedge members 88. Thus, rotation of nut 112 can selectively expand and contract the cross-sectional profile of the wedge members 88 forming the wing section 93.

In the stage of assembly shown in FIG. 14, the core element 108 has been partially, but not completely, drawn between the wedge members 88. As a result, the cross-sectional profile of the wedge members 88 forming the wing section 93 remains contracted. This stage is shown in more detail in the enlarged view of FIG. 15.

Figure 15:
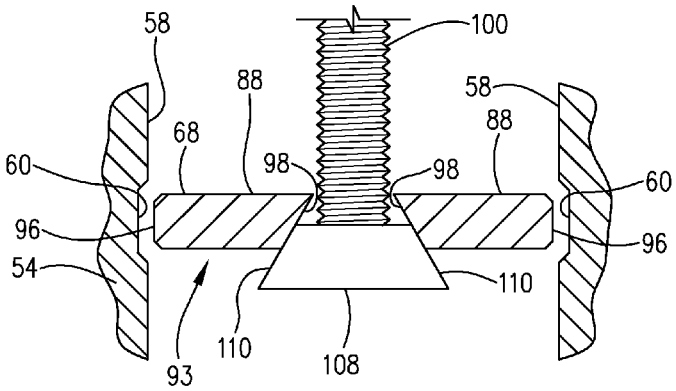
FIG. 15 is an enlarged cross-sectional view showing the wing section, core element and inner shaft of an unloading tool within a base retainer element that has been loaded into a stuffing box. The cross-sectional profile of the wing section is contracted, so that the wedge members do not engage the internal walls of the base retainer element.

FIG. 15 shows the wedge members 88 of wing section 93 and core element 108 positioned within a base retainer element 54. Because the cross-sectional profile of wing section 93 is not enlarged, the outer side surfaces 96 of wedge members 88 do not contact the internal walls 58 of the base retainer element 54. In this configuration, the unloading tool 64 can be used to insert wing section 93 into the base retainer element 54, position it within base retainer element 54, and remove it from base retainer element 54.

By tightening the nut 112, the core element 108 can be completely drawn between the wedge members 88. As a result, the cross-sectional profile of the wedge members 88 forming wing section 93 is expanded. This stage of assembly is shown in FIG. 16, and in more detail in the enlarged view of FIG. 17.

As the core element 108 is drawn upward by the inner shaft 100, its outer side surfaces 110 slide along the complementary inner side surfaces 98 of the wedge members 88, and move the wedge members 88 radially outward. The result is a gradual expansion of the cross-sectional profile of the wing section 93. This expansion is illustrated in FIGS. 15 and 17.

Figure 17:
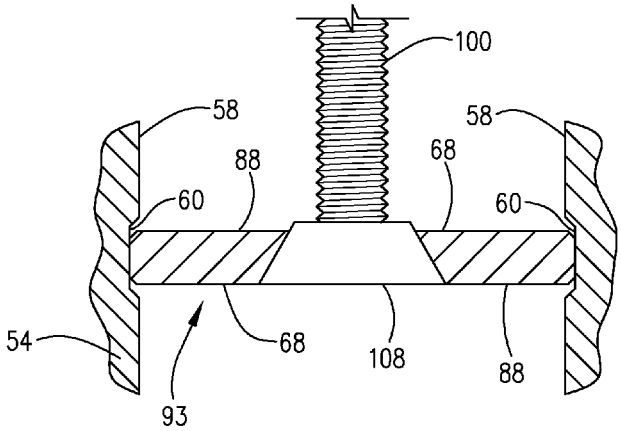
FIG. 17 is an enlarged cross-sectional view showing the wing section, core element and inner shaft of the unloading tool shown in FIG. 16. The cross-sectional profile of the wing section is expanded, so that the wedge members engage the internal walls of the base retainer element.

FIG. 17 shows the wedge members 88 forming wing section 93 and core element 108 positioned within a base retainer element 54. Because the cross-sectional profile of wing section 93 is enlarged, the outer side surfaces 96 of wedge members 88 tightly engage the internal walls 58 of the base retainer 54. Preferably, this engagement occurs at raceway 60. In this engaged configuration, grip element 68 and base retainer element 54 are effectively converted into a single piece.

FIGS. 18 and 19 show a plug element 116 adapted for coaxial and removable engagement with a box closure element 62 that serves as the uppermost packing element 52 in a loaded stuffing box 36. The plug element 116 is characterized by coaxial, annular and adjacent lower and upper sections 118 and 120. Preferably, each section has a circular cross-sectional profile. The lower section 118 is sized to be closely, but fittingly received within the central opening of annular box closure element 62 at its upper end 122.

The upper section 120 has a planar upper surface 124 that extends in orthogonal relationship to the longitudinal axis of the plug element 116. A peripheral lower surface 126 extends in parallel relation to the upper surface 124. The cross-sectional dimensions of the upper section 120 exceed those of lower section 118, so that lower surface 126 can rest on the upper end 122 of box closure element 62.

Formed in the plug element 116 is a centrally and axially disposed bore 128 through which the outer shaft 66 is receivable. Preferably, the bore 128 is provided with internal threads that mate with the external threads formed on the outer shaft 66. At its base, the bore 128 opens into an enlarged internal chamber 130 having a planar upper wall 132 that extends parallel to the upper surface 124.

The internal chamber 130 is adapted to axially receive at least the upper portion of the stop element 80, so that the upper surface of the stop element 80 is disposed in face-to-face engagement with the upper wall 132.

Preferably, the plug element 116 is formed as a single, homogeneous piece of material. In one embodiment, the plug element 116 is formed from 6061-T6 aluminum alloy. The external diameter of lower section 118 is 3.049 inches, and the external diameter of the upper section 120 is 3.5 inches. The thickness of the lower section 118 is 0.5 inches, and the thickness of the upper section 120 is likewise 0.5 inches. The internal chamber 130 has a circular cross-sectional profile with a diameter of 2.0 inches. The depth of the internal chamber 130 is 0.25 inches.

Figure 20:
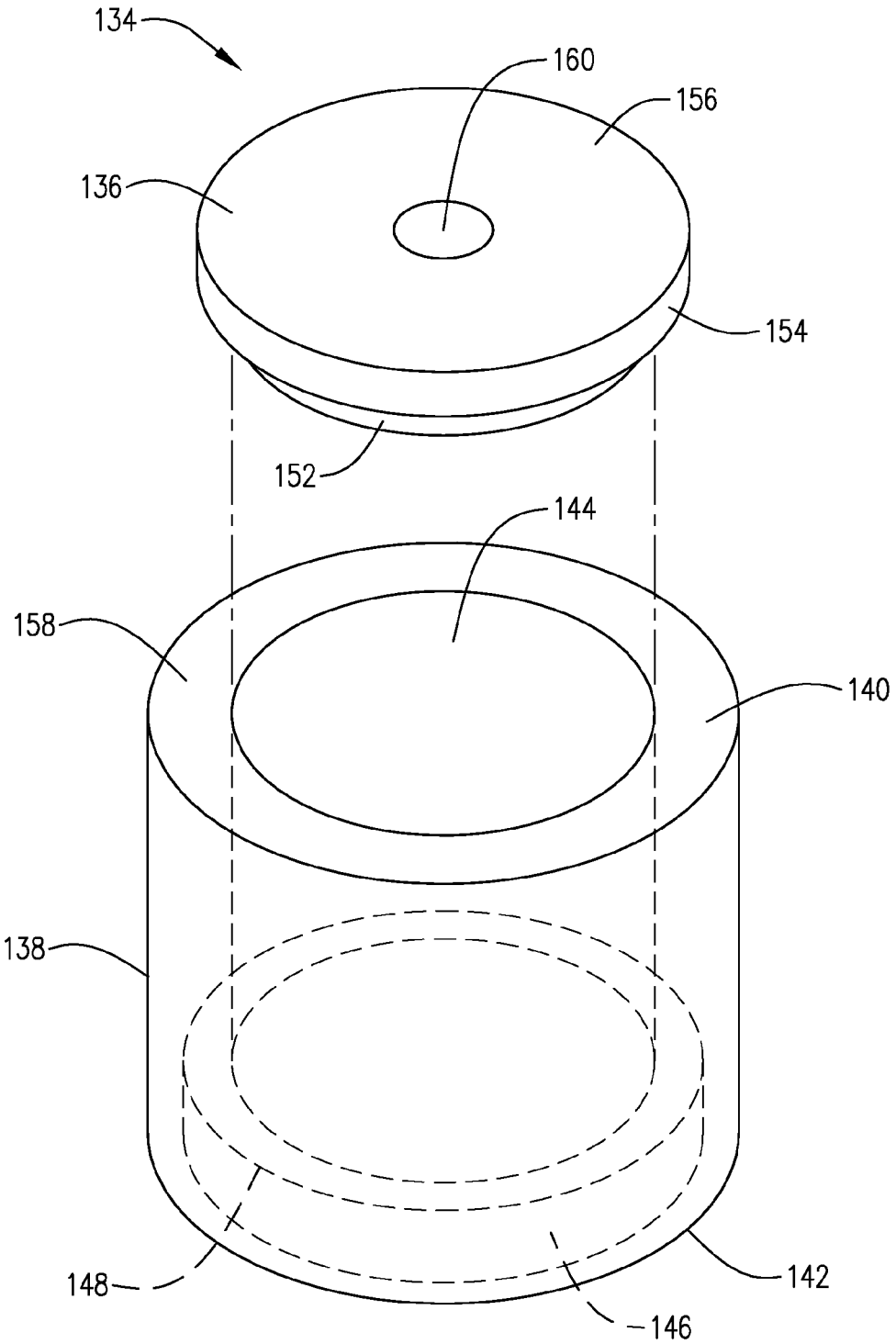
FIG. 20 is a perspective view of an elevation element and a platform element.

FIG. 20 shows a longitudinally offset platform system 134 that can position the outer shaft 66 of unloading tool 64 in coaxial alignment with a stuffing box 36 within the footing element 10. The platform system 134 includes a platform element 136 and an elevation element 138.

Figure 24:
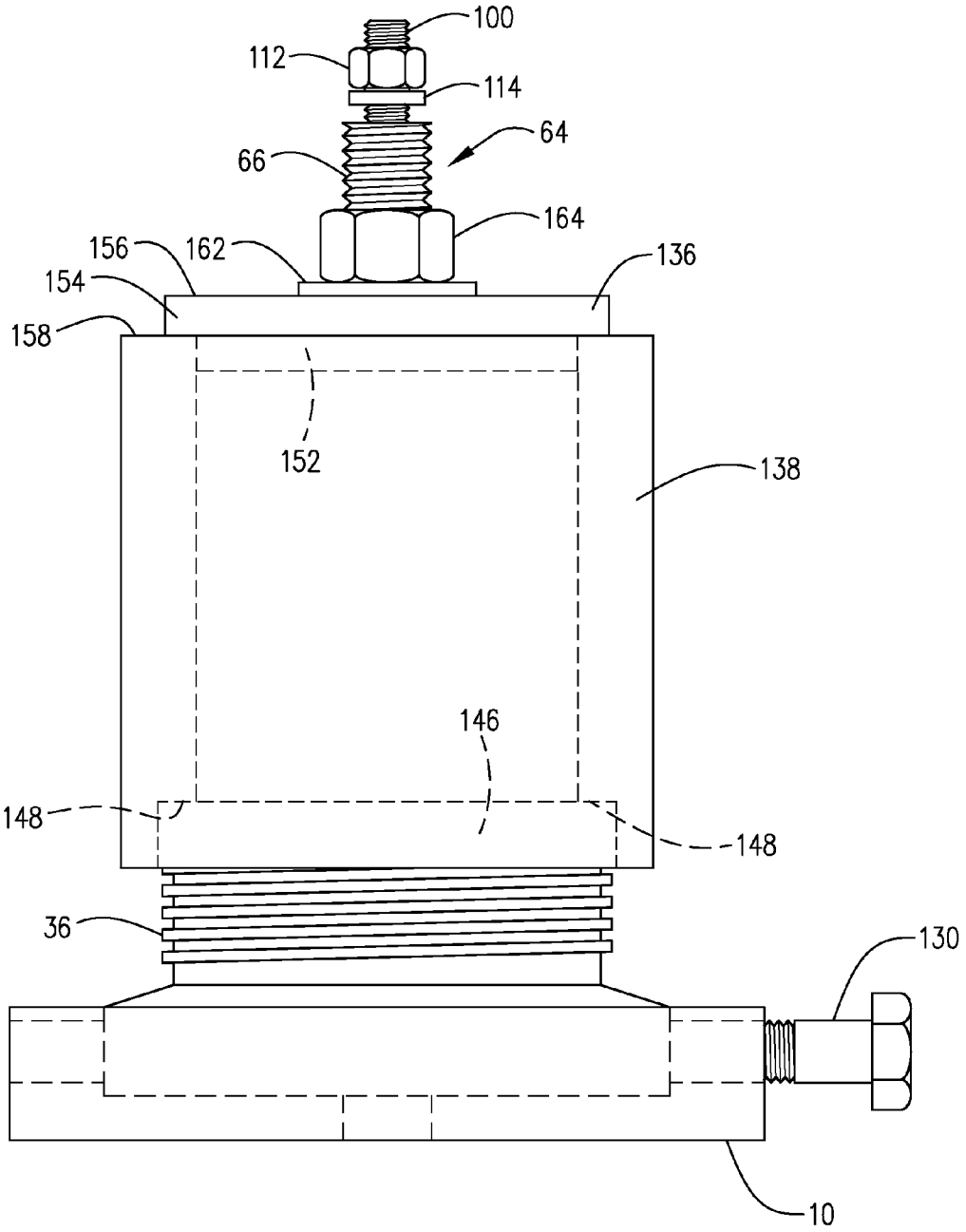
FIG. 24 is a front elevation view showing a later stage of unloading of stuffing box of FIGS. 21-23. An elevation element has been set atop the stuffing box. A platform element has been lowered into the upper end of the elevation element.

The elevation element 138 stably positions the platform element 136 in longitudinally offset relationship to a stuffing box 36 within the footing element 10. In the embodiment shown in the Figures, the elevation element 138 comprises a tubular member formed as a right circular cylinder, with open upper and lower ends 140 and 142. An internal bore 144 extends through the elevation element 138 from the upper end 140 toward the lower end 142. As shown in FIG. 24, the bore 144 opens adjacent the lower end 142 into an enlarged internal chamber 146 having an annular and planar upper wall 148.

The internal chamber 146 should be shaped and sized to closely but clearingly conform to the external contour of the upper portion of the stuffing box 36. As shown in FIG. 24, the internal chamber 146 is shaped and sized to receive the upper portion of the stuffing box 36. In this configuration, the elevation element 138 sits stably atop the stuffing box 36 with the upper wall 148 and the planar upper surface 150 of the stuffing box 36 in face-to-face engagement. Preferably, the elevation element 138 is formed from a single, homogeneous piece of material.

The platform element 136 is characterized by coaxial, annular and adjacent lower and upper sections 152 and 154. Preferably, each section has a circular cross-sectional profile. The lower section 152 is sized to be closely but fittingly received within the central opening of elevation element 138 at its upper end 140. Preferably, the platform element 136 is formed as a single, homogeneous piece of material.

The upper section 154 has a planar upper surface 156 that extends in orthogonal relationship to the longitudinal axis of the platform element 136. A peripheral lower surface extends in parallel relation to the upper surface 156. The cross-sectional dimensions of the upper section 154 exceed those of lower section 152, so that the lower surface can rest stably on the planar and annular upper surface 158 of the elevation element 138.

Formed in the platform element 136 is a centrally and axially disposed bore 160 the extends through both the lower and upper sections 152 and 154. The cross-sectional dimensions of the bore 160 should be sufficient to permit the outer shaft 66 to extend therethrough. Preferably, the bore 160 is smooth, rather than threaded.

In one embodiment, the platform element 136 is formed from 6061-T6 aluminum alloy. The lower section 152 has a thickness of 0.5 inches and a cross-sectional profile having a diameter of 4.290 inches. The upper section 154 has a thickness of 0.5 inches and a cross-sectional profile having a diameter of 5.0 inches. The diameter of bore 160 is 1 inch.

In the same embodiment, the elevation element 138 is likewise formed from 6061-T6 aluminum alloy. The elevation element 138 has a height of 6 inches and a cross-sectional profile having a diameter of 6 inches. The bore 160 has a length of 5.25 inches and a diameter of 4.3 inches. Internal chamber 146 has a height of 0.75 inches and a diameter of 5.5 inches.

Figure 21:
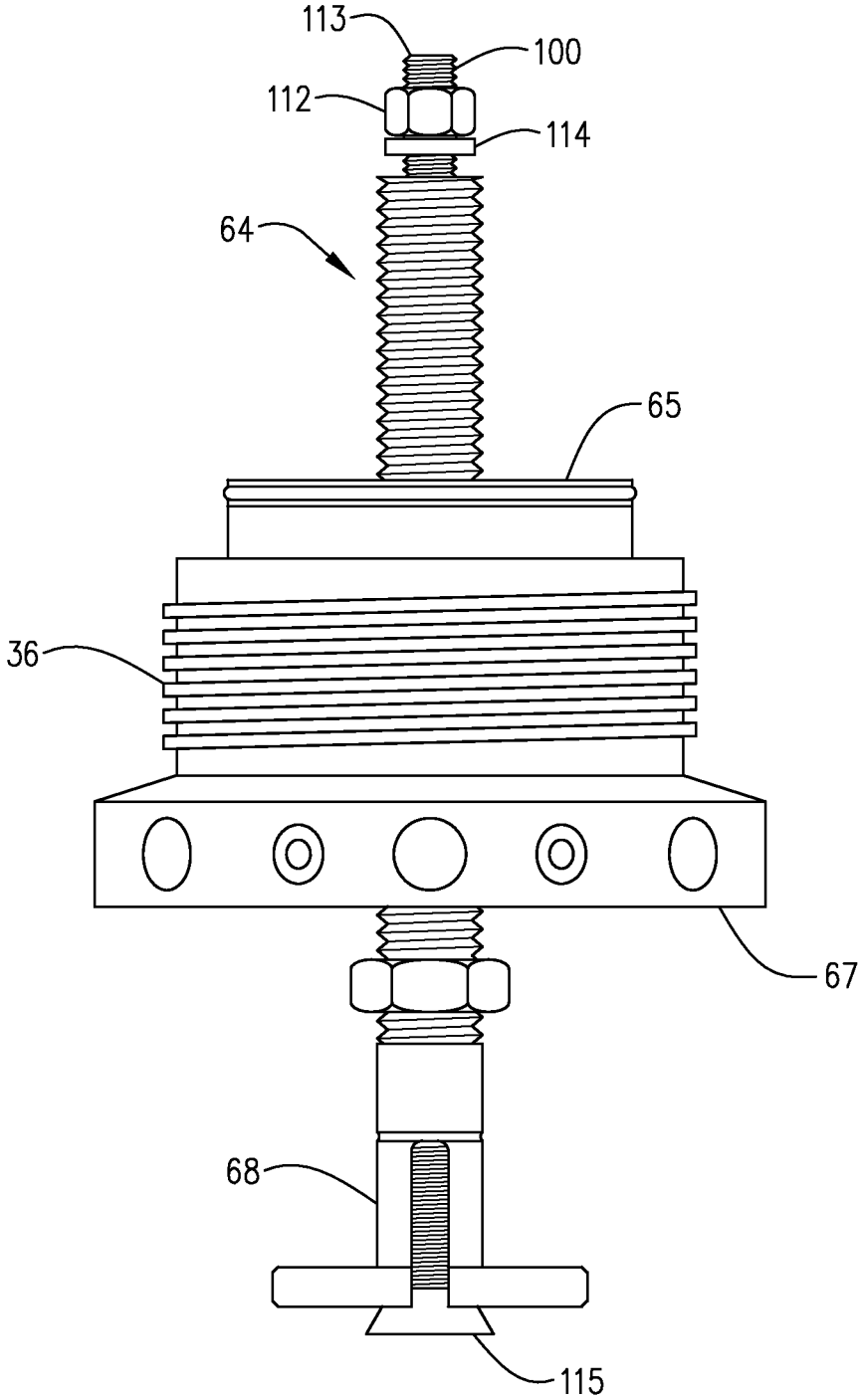
FIG. 21 is a front elevation view showing an unloading tool being drawn upwardly through the base retainer element of a loaded stuffing box.

FIGS. 21-26 illustrate use of the unloading tool 64 and other components to remove packing elements 52 from a loaded stuffing box 36. The first step, shown in FIG. 21, requires insertion of the assembled unloading tool 64 into the stuffing box 36. The upper end 113 of the unloading tool 64 is inserted into the bore 46 formed at the lower end 67 of the stuffing box 36. The unloading tool 64 is pushed through the internal channel 63 defined by the loaded packing elements 52 until it emerges at upper end 65, as shown in FIG. 21. Insertion continues until the grip element 68 is fully contained within channel 63, adjacent the lower end 67 of the loaded stuffing box 36.

Figure 22:
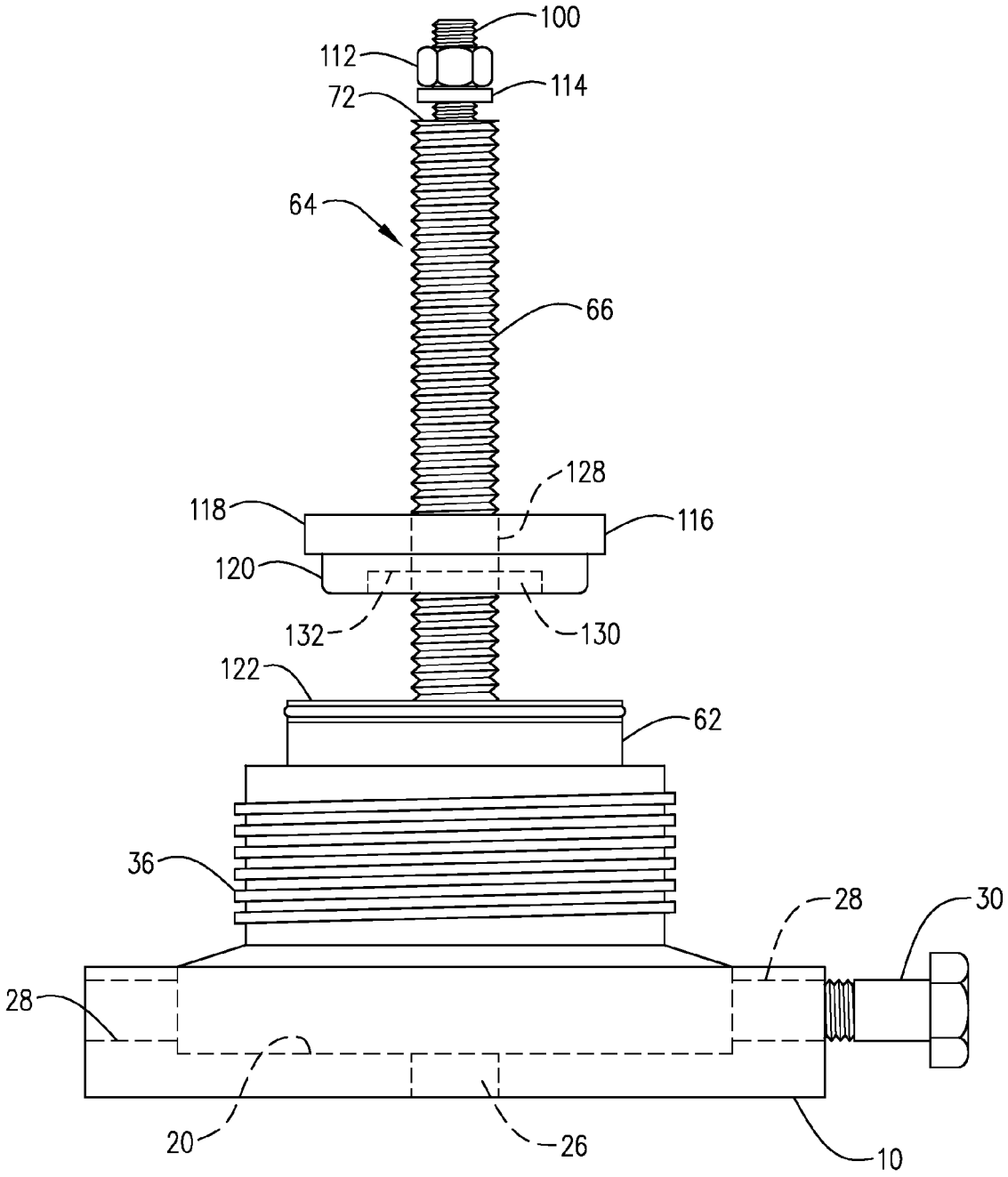
FIG. 22 is a front elevation view showing a later stage of unloading of stuffing box of FIG. 21. The unloading tool has been drawn further upward, such that the wing section is fully positioned within the base retainer element. The stuffing box has then been lowered into the recessed receptacle of the footing element. A plug element has been partially installed on the threaded outer shaft of the unloading tool.

The next stage of unloading is shown in FIG. 22. The loaded stuffing box 36, together with the inserted unloading tool 64 that it carries, is lowered into the receptacle 20 of footing element 10. The stuffing box 36 is rotated within receptacle 20, if necessary, to align the openings 44 with the anchor sockets 28. The bolts 30, one of which is shown in FIG. 22, are then actuated in the anchor sockets 28 to lock the stuffing box 36 within the footing element 10.

The plug element 116 is threaded onto the first end 72 of the outer shaft 66 of unloading tool 64. The internal threads within bore 128 of the plug element 116 mate with the external threads formed on the outer shaft 66. The plug element 116 is rotated to lower it on outer shaft 66 toward the upper end 65 of the loaded stuffing box 36, as shown in FIG. 22.

The plug element 116 is rotated downward on outer shaft 66 until it engages the fixed stop element 80 formed on the outer shaft 66. Movement of the plug element 116 toward the second end 74 of outer shaft 66 must stop when the upper end of stop element 80 engages the upper wall 132 of the internal chamber 130 formed within the plug element 116.

Figure 23:
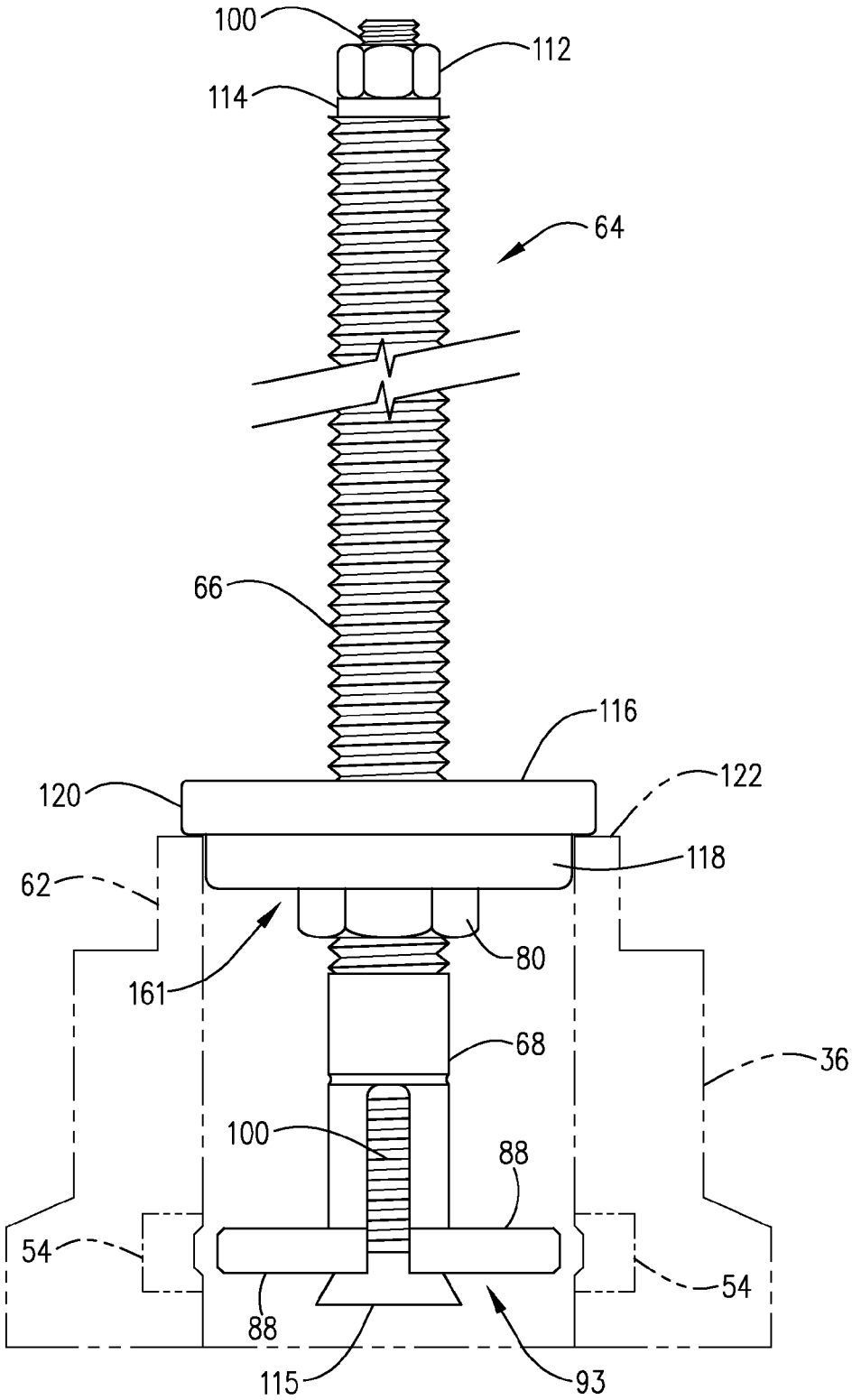
FIG. 23 is a front elevation view showing a later stage of unloading of stuffing box of FIGS. 21 and 22. The stuffing box is shown in phantom lines and the footing element has been omitted. The plug element has been fully installed in the stuffing box, and engages the stop element on the outer shaft of the unloading tool.

Once further downward movement of the plug element 116 is restrained by stop element 80, the plug element 116 seats in the upper end 65 of the loaded stuffing box 36. This stage of unloading is shown in FIG. 23. The lower section 118 of the plug element 116 is received in the channel 63 at its upper end, and the upper section 120 rests against the box closure element 62 at upper end 122.

The fixed position of the stop element 80 on outer shaft 66 is chosen to establish a particular position for the wedge members 88 forming the wing section 93 of the grip element 68. Specifically, when the stop element 80 is seated against the plug element 116 as described above, the wedge members 88 forming wing section 93 should be positioned within base retainer element 54 of loaded stuffing box 36. The plug element 116 and the stop element 80 thus cooperate to form a positioning system 161 that releasably maintains the wing section 93 within the base retainer element 54.

The next stage of unloading is shown in FIG. 24. The tubular elevation element 138 is lowered over the loaded stuffing box 36 and around outer shaft 66 and box closure element 62 until the planar upper wall 148 within the elevation element 138 engages the planar upper surface 150 of the stuffing box 36. The lowered elevation element 138 sits stably atop the stuffing box 36.

The first end 72 of outer shaft 66 is inserted axially through the bore 160 of platform element 136. The platform element 136 is then lowered around outer shaft 66 until its upper section 154 is seated against the upper surface 158 of elevation element 138, as shown in FIG. 24.

The elevation element 138 supports the platform element 136 in a stable, longitudinally offset position above both footing element 10 and the loaded stuffing box 36. The central position of bore 160 enables the platform element 136 to position the outer shaft 66 of an unloading tool 64 in coaxial alignment with a stuffing box 36 within footing element 10 and with its contained packing elements 52. In addition, the elevation of platform element 136 provides an offset orthogonal plane, upper surface 156, where an unloading force may be applied to the outer shaft 66.

A flat and annular washer 162 is lowered around the outer shaft 66 from first end 72 to a position engaging the upper surface 156 of the platform element 138. An annular nut 164 is then lowered around the outer shaft 66 from first end 72 to a position engaging the washer 162. In one embodiment, the nut 164 is formed as a wing nut. The nut 164 is provided with internal threads that mate with the external threads of the outer shaft 66. If necessary to obtain clearance, the nut 112 and 114 may be temporarily removed from inner shaft 100 while installing the washer 162 and nut 164.

Figure 25:
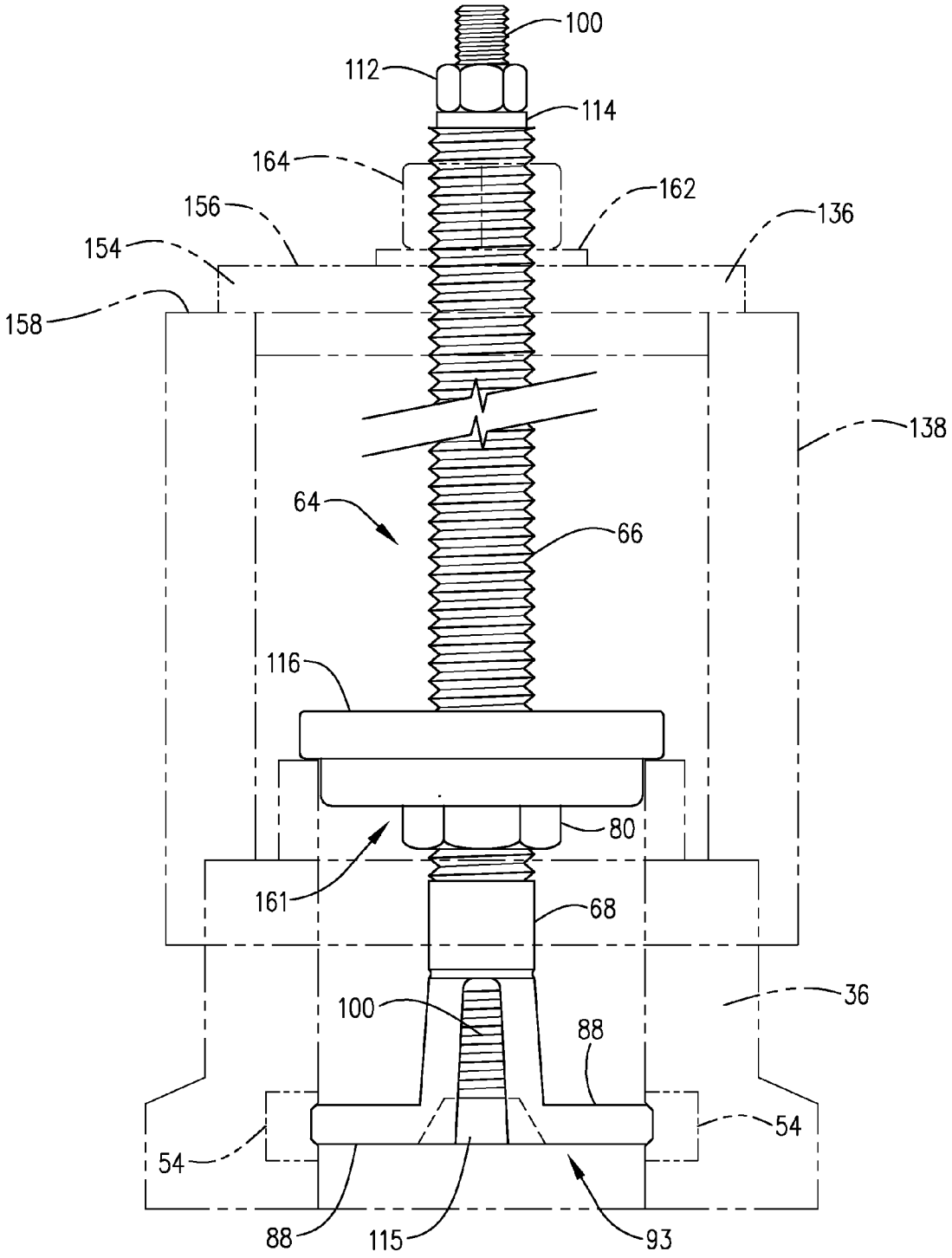
FIG. 25 is a front elevation view showing a later stage of unloading of stuffing box of FIGS. 21-24. The elevation element, platform element and stuffing box, and the lower nut and washer, are shown in phantom lines. The footing element has been omitted. The inner shaft has been fully retracted to enlarge the wing section, which engages the internal walls of a base retainer element, shown in phantom lines.

In the next stage of unloading, the unloading tool 64 is actuated to enlarge to cross-sectional profile of the wing section 93 so as to bring the outer side surfaces 98 of the wedge members 88 into tight engagement with the internal walls 58 of the base retainer element 54. Actuation of the unloading tool 64 is carried out by rotating and tightening nut 112 on inner shaft 100. This stage of the unloading process is shown in FIGS. 17 and 25.

The actuation step temporarily converts the unloading tool 64 and the base retainer element 54 into a single piece. The next stage of the unloading process involves application of an unloading force to remove that single piece from the stuffing box 36.

The unloading force is applied to the unloading tool at the platform element 136 by rotating and tightening nut 164 against washer 162, which presses on planar upper surface 156. The rotational force applied at platform element 136 is converted by the mating threads on nut 164 and outer shaft 66 into an axial unloading force.

Platform element 136 and footing element 10 cooperate to maintain outer shaft 66 in coaxial alignment with stuffing box 36 and its contained packing elements 52. At the same time, elevation element 138 and footing element 10 cooperate to maintain platform element 136 in orthogonal relationship to the outer shaft 66. As result, any radial component to the unloading force is minimized.

The axial unloading force applied to outer shaft 66 dislodges the base retainer element 54 and pulls it out of the stuffing box 36. Because the remaining packing elements 52 are situated above the base retainer element 54, removal of the unitary piece concurrently dislodges and removes the remaining packing elements 52 as well.

Figure 26:
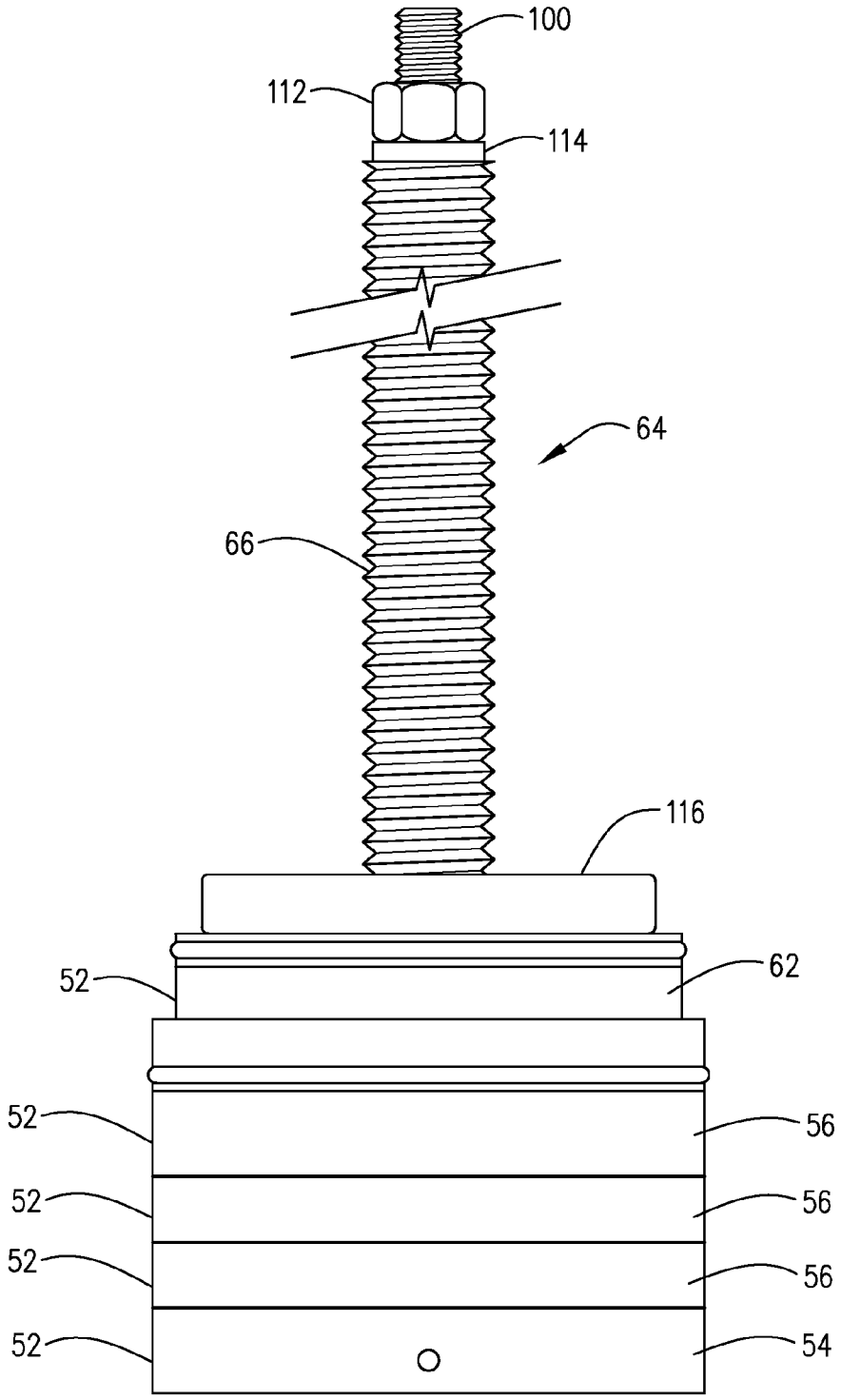
FIG. 26 is a front elevation view showing a later stage of unloading of stuffing box of FIGS. 21-25. The unloading tool has been withdrawn from the stuffing box, together with the base retainer element, seals, box closure element and plug element.
Figure 27:
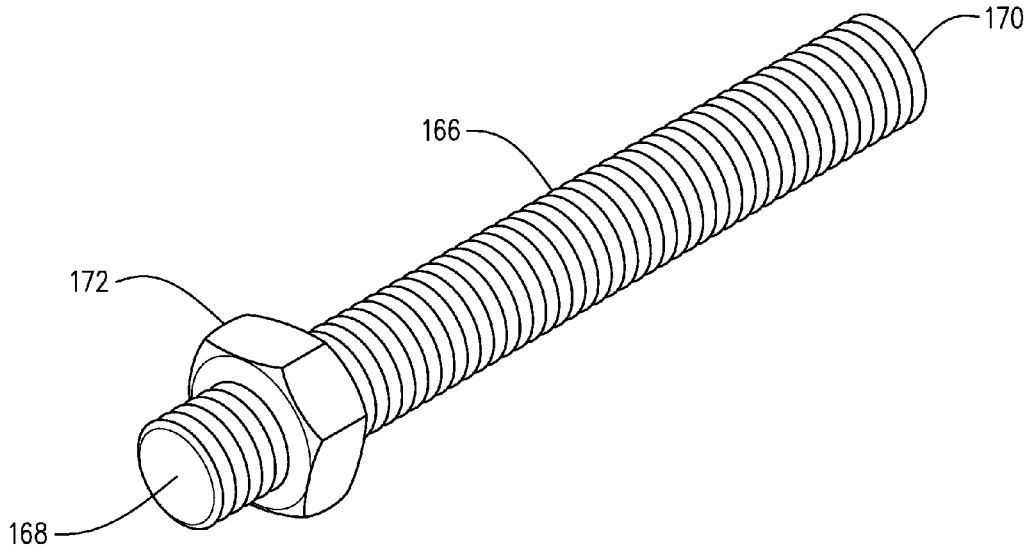
FIG. 27 is a perspective view of a loading shaft.

After the packing elements 52 have been dislodged from the stuffing box 36, the nut 164 and washer 162 are removed from outer shaft 66. The platform element 136 and elevation element 138 are then removed from their positions above the stuffing box 36. The outer shaft 66 is then lifted from the stuffing box 36, carrying the base retainer element 54, the remaining packing elements 52 and the plug element 116 with it, as shown in FIG. 26.

After the unloading tool 64 has been withdrawn from the stuffing box 36, the plug element 116 may be removed from the outer shaft 66, and unloading tool 64 deactuated to disengage it from the base retainer element 54. The packing elements 52 are then removed from the outer shaft 66.

FIGS. 27-31 illustrate the construction and use of a loading system for a stuffing box. The system includes the elongate loading shaft 166 shown in FIG. 27. The loading shaft 166 has opposed first and second ends 168 and 170 and is externally threaded along its entire length. A stop element 172 having an enlarged cross-sectional profile is externally formed on the loading shaft 166 adjacent its first end 168. Preferably, the stop element 172 comprises a nut having internal threads that mate with the external threads formed on the loading shaft 166. The stop element 172 is held in a fixed position on the loading shaft 166, preferably by a set screw or an adhesive.

The external threads formed on the loading shaft 166 mate with the internal threads formed in the shaft socket 26 formed in the base 24 of receptacle 20. The loading shaft 166 may be removably engaged with the footing element 10 by threading its first end 168 into the shaft socket 26 at base 24. The loading shaft 166 becomes fully engaged with footing element 10 when stop element 172 contacts base 24 and prevents further shaft rotation, as shown in FIG. 29. The loading shaft 166 may be disengaged and removed from footing element 10 by reversing these steps.

Figure 28:
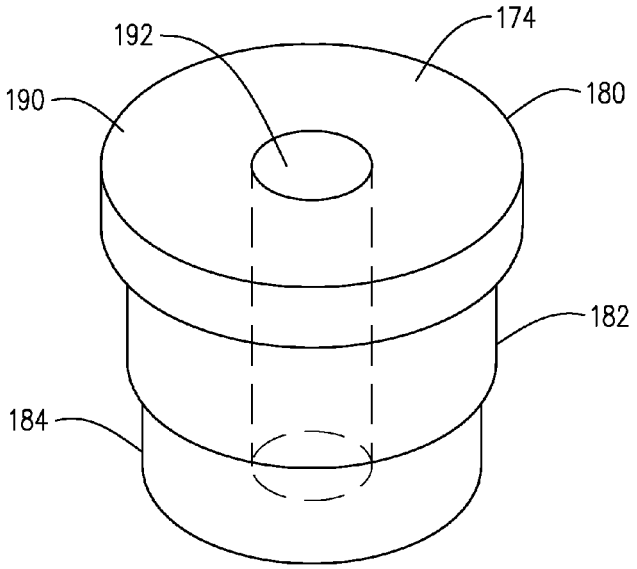
FIG. 28 is a perspective view of an insertion element. Hidden portions of the internal bore formed in the insertion element are shown in dashed lines.
Figure 25:
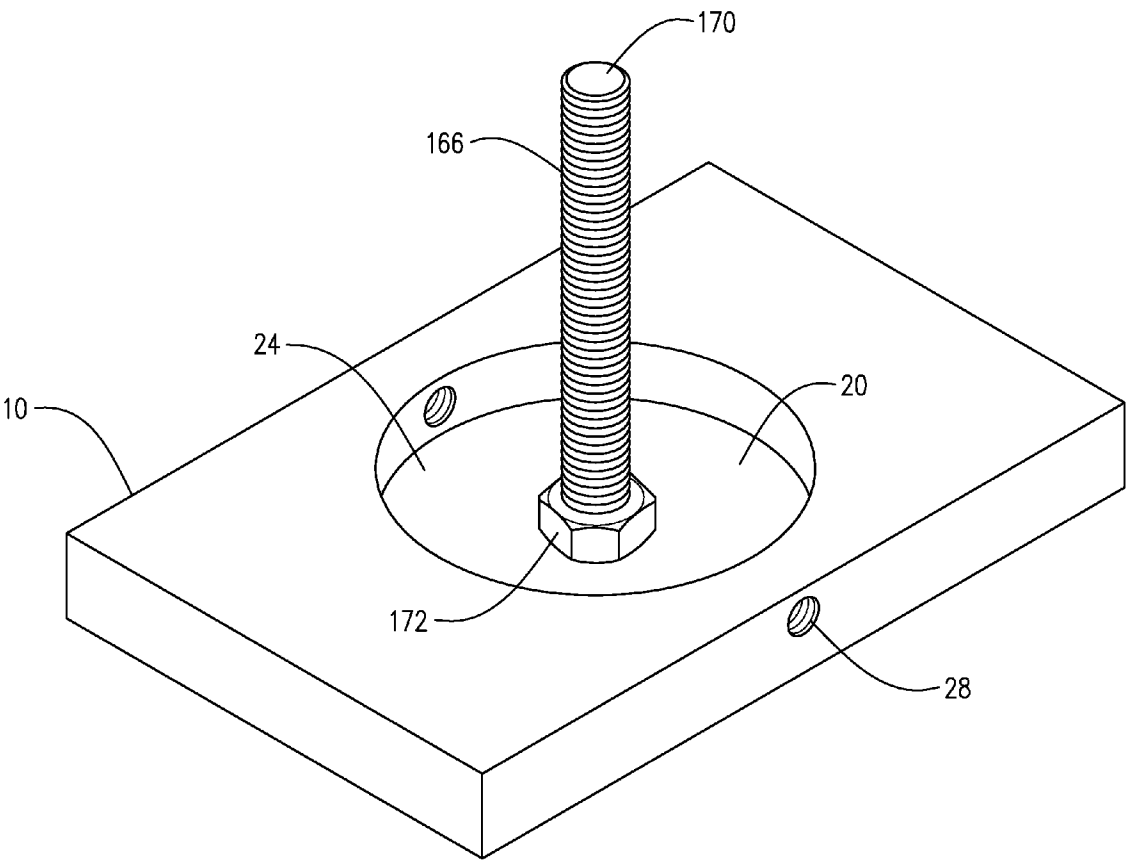

FIG. 28 shows an insertion element 174 adapted to be coaxially and removably received atop annular packing elements 176 to be loaded into a stuffing box 178. The insertion element 174 is characterized by coaxial and annular upper, middle and lower sections 180, 182 and 184 that are arranged in stacked and adjacent relationship. Preferably, the insertion element 174 is formed as a single, homogeneous piece of material.

Preferably, each section of the insertion element 174 has a circular cross-sectional profile and a right cylindrical shape. The cross-sectional dimensions of the upper section 180 exceed those of the middle section 182, which in turn exceed those of the lower section 184.

The upper section 180 has a planar upper surface 190 that extends in orthogonal relationship to the longitudinal axis of the insertion element 174. A peripheral lower surface extends in parallel relation to the upper surface 190, so that the lower surface can rest stably on the planar surface at the upper end 188 of box closure element 186. The middle section 182 is sized to be closely, but fittingly received within the central opening of annular box closure element 186 at its upper end 188.

Formed in the insertion element 174 is a centrally and axially disposed bore 192 through which the loading shaft 166 is receivable. The bore 192 extends for the entire length of the insertion element 174. Preferably, the bore 192 is defined by smooth walls.

In one embodiment, the loading shaft 166 is a cylindrical steel rod having a length of 7 inches, a diameter of 1 inch and 8 external threads per inch of length. The stop element 172 is a 1-inch nut having a base situated 0.5 inches from the first end 168. The nut is held in a fixed position on the loading shaft 166 by an adhesive such as Loctite.

In the same embodiment, the insertion element 174 is formed from 6061-T6 aluminum alloy. The heights of the cylindrical upper, middle and lower sections 180, 182 and 184 are 0.5 inches, 1.15 inches and 0.9 inches respectively. The overall height of the insertion member 174 is 2.55 inches. The diameters of the upper, middle and lower sections 168, 170 and 172 are 3.5 inches, 3.06 inches and 1.82 inches respectively. The bore 192 has a circular cross-sectional profile and a diameter of 1 inch.

In the first stage of loading, the loading shaft 166 is assembled with the footing element 10, as shown in FIG. 29. In the next stage of loading, the stuffing box 178 is lowered around loading shaft 166 and into the receptacle 20 of the footing element 10. The bolts 30 are then actuated to lock the stuffing box 178 within the footing element 10, as shown in FIG. 30.

Figure 30:
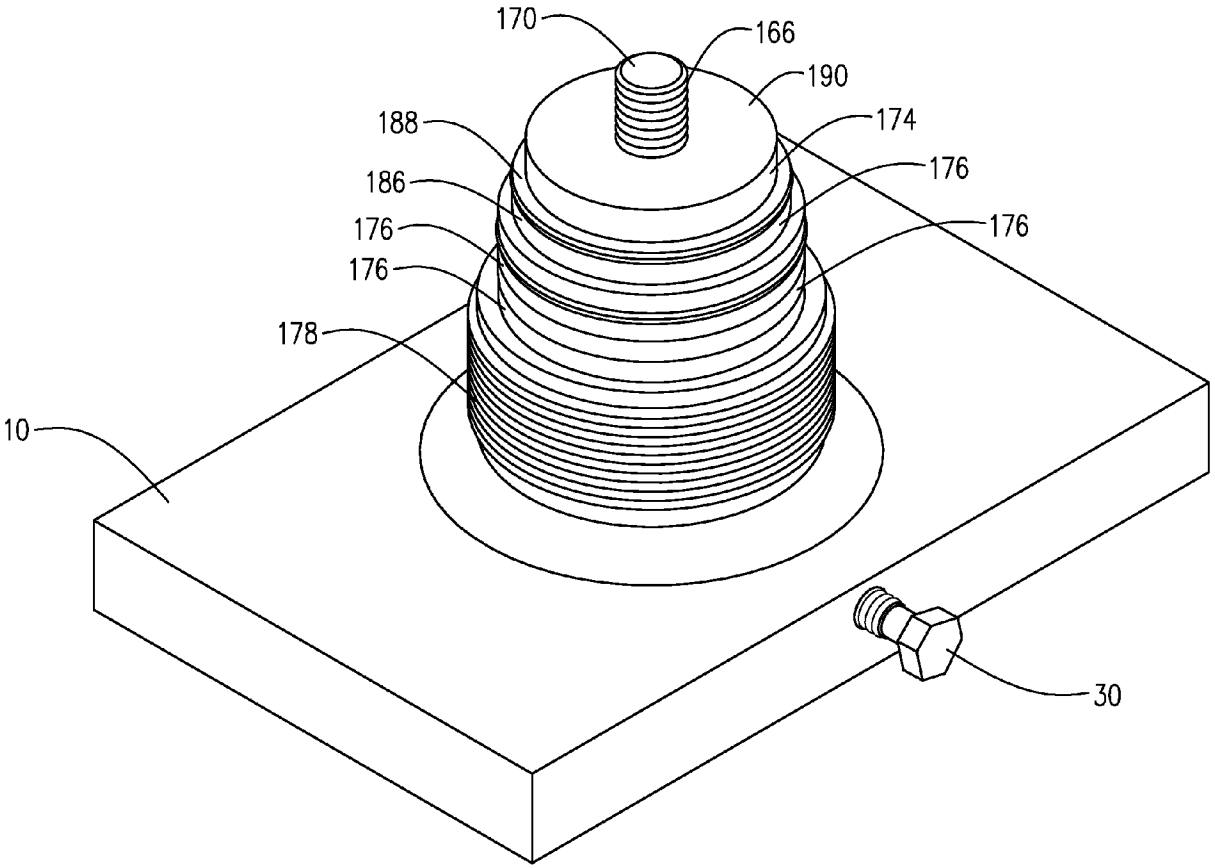
FIG. 30 is a perspective view showing a stuffing box that has been lowered into the recessed receptacle of the footing element shown in FIG. 29. A stack of packing elements, with a box closure element at the top, has been partially lowered into the bore of the stuffing box. An insertion element has been installed atop the box closure element.
Figure 21:
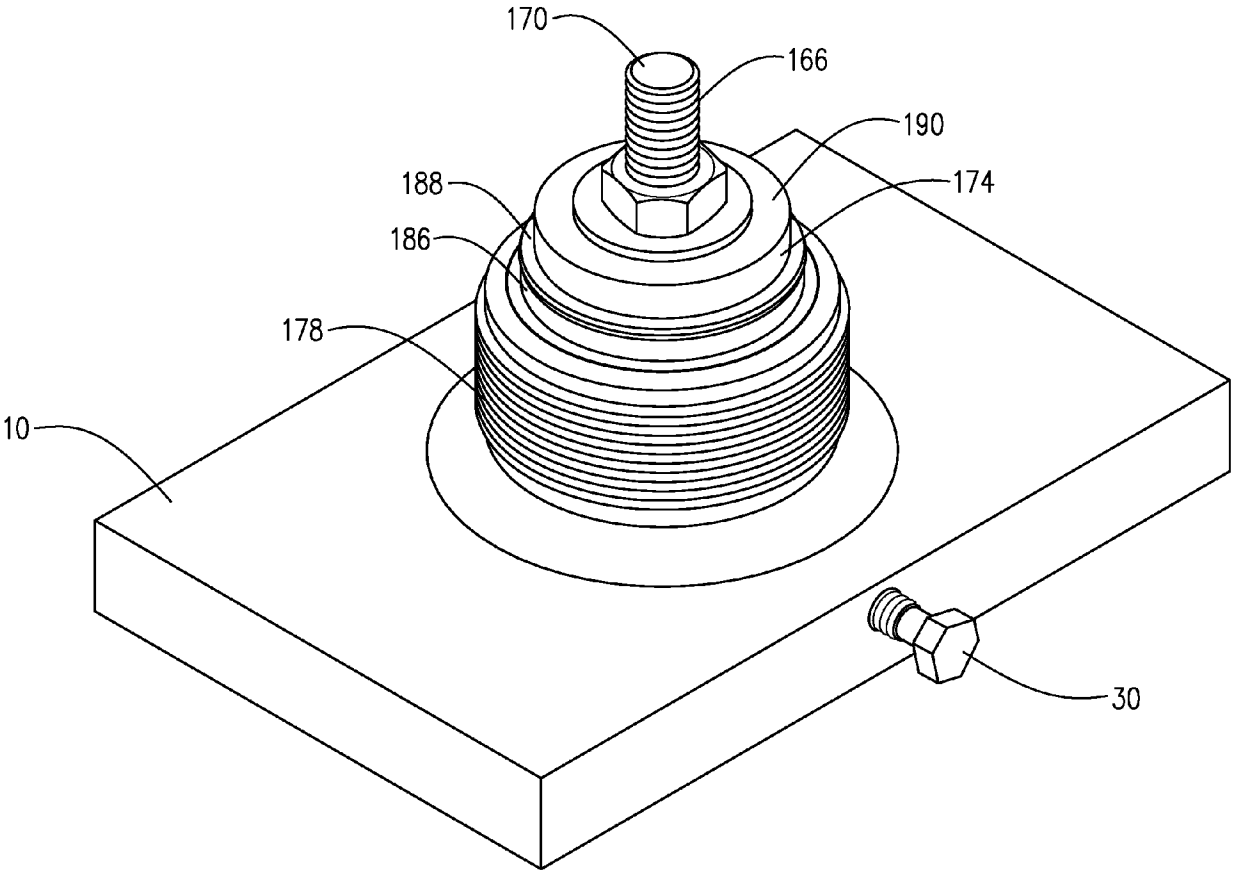

The next stage of loading is also shown in FIG. 30. Packing elements 176 are lowered manually around the loading shaft 166 and into the internal bore of the stuffing box 178. The lowermost packing element 176 will be a base retainer element, followed by one or more seals, followed by a box closure element 186 that will be the uppermost packing element 176 to be loaded.

Because of the small tolerances between the outer surfaces of the packing elements 176 and the walls of the bore, complete manual loading of the packing elements 176 will not normally be possible. The box closure element 186, at a minimum, will likely remain at least partially unloaded at this stage of the process, as shown in FIG. 30. Lower-positioned packing elements 176, such as seals, may remain less than fully loaded as well.

In the next stage of the loading process, the insertion element 174 is lowered around loading shaft 166 and into engagement with box closure element 186. The middle section 182 is fittingly received within the bore of the box closure element 186, and the upper section 180 rests stably atop the planar upper surface of the box closure element, as shown in FIG. 30. The footing element 10 and loading shaft 166 cooperate to maintain the planar upper surface 190 of the insertion element 174 in orthogonal relationship to the longitudinal axis of the stuffing box 178.

The next stage of the loading process is illustrated in FIG. 31. A flat and annular washer, such as washer 162, is lowered around the loading shaft 166 from first end 168. Lowering continues until the washer engages the upper surface 190 of the insertion element 174. An annular nut, such as nut 164, is then lowered around the loading shaft 166 from first end 168 to a position engaging the washer. In one embodiment, the nut is formed as a wing nut. The nut is provided with internal threads that mate with the external threads of the loading shaft 166.

The next stage of the loading process involves application of a loading force to urge the packing elements 176 into the stuffing box 178. The loading force is applied to the packing elements 176 at the upper surface 190 of insertion element 174, by rotating and tightening nut 164 against washer 162, which presses against planar upper surface 190.

The rotational force applied at upper surface 190 is converted by the mating threads on nut 164 and loading shaft 166 into an axial loading force. That force urges the insertion element 174, and the packing elements 176 below it, in an axially downward direction, causing the packing elements 176 to load into the stuffing box 178, as shown in FIG. 31. Because the loading shaft 166 is maintained in coaxial relationship to the stuffing box by footing element 10, and because planar upper surface 190 of the insertion element 174 is orthogonal that axis, any radial component to the loading force is minimized.

Once the packing elements 176 are loaded, the washer 162 and nut 164 are removed from the loading shaft 166. The bolts 30 are deactuated to unlock the stuffing box 178 from the footing element 10. The loaded stuffing box 178 may then be lifted from receptacle 20 and returned to use. Any two or more of the components described herein, aside from stuffing boxes 36 and 178 and packing elements 52 and 176, may be collected to form a kit. Such a kit may include the footing element 10 and its components, the unloading tool 64 and its components, the platform system 134 and its components, the positioning system 161 and its components, washer 162, nut 164, loading shaft 166 and insertion element 174. Kit components may be unassembled, partially assembled or fully assembled.

Changes may be made in the construction, operation and arrangement of the various parts, elements, steps and procedures described herein without departing from the spirit and scope of the invention as described in the following claims.

The invention claimed is:

1. A kit for unloading a stuffing box loaded with stacked annular packing elements, including a lowermost base retainer element having internal walls, comprising:

a footing element adapted to releasably engage and maintain the stuffing box in a fixed position; and one or more components that can form an unloading tool adapted to engage the internal walls of the loaded base retainer element, comprising:

an elongate and hollow outer shaft;

an elongate inner shaft receivable within the outer shaft and longitudinally movable relative to the outer shaft; and a grip element positionable at one end of the outer shaft, the grip element having a wing section with a cross-sectional profile that can be selectively contracted and expanded.

2. The kit of claim 1, further comprising:

one or more components that can form a positioning system adapted to releasably maintain the wing section within the base retainer element.

3. The kit of claim 2 in which the uppermost packing element within the stuffing box is characterized as a box closure element and in which the one or more components that can form a positioning system comprise:

a plug element adapted for coaxial and removable engagement with the loaded box closure element, the plug element having a centrally disposed bore through which the shaft is receivable; and a stop element formed on the shaft and engageable with the installed plug element such that the wing section is maintained within the base retainer element.

4. The kit of claim 3, further comprising:

one or more components that can form a longitudinally offset platform system that can position the shaft of an unloading tool in coaxial alignment with a stuffing box within the footing element.

5. The kit of claim 1, further comprising:

one or more components that can position the shaft of an unloading tool in coaxial alignment with a stuffing box within the footing element.

6. The kit of claim 5 in which the one or more components that can position the shaft comprise:

a platform element having a centrally disposed bore through which the shaft may be closely but clearingly received; and an elevation element adapted to stably position the platform element in longitudinally offset relationship to a stuffing box within the footing element.

7. The kit of claim 1 in which the stuffing box is characterized by an external flange, and in which footing element comprises:

a plate having a recessed receptacle sized to closely but clearingly receive the external flange.

8. The kit of claim 7 in which the footing element further comprises:

a releasable locking system adapted to restrain the stuffing box within in the receptacle.

9. The kit of claim 8 in which the plate is characterized by an externally opening socket communicating with the receptacle and in which the locking system comprises:

an adjustable fastener receivable within the socket and adapted to engage the stuffing box within the receptacle.

10. The kit of claim 1 further characterized as a kit for loading the stuffing box, and further comprising:

an elongate loading shaft removably engagable with the footing element and coaxially extendable through a stuffing box engaged within the footing element; and an insertion element adapted to be coaxially and removably received atop annular packing elements to be loaded into the stuffing box, the insertion element having a planar upper surface and an internal bore through which the loading shaft is closely but clearingly receivable.

11. An assembly comprising:

a stuffing box loaded with stacked annular packing elements, including a lowermost base retainer element having internal walls, the stacked packing elements defining an internal channel;

a footing element that releasably engages and maintains the stuffing box in a fixed position; and an unloading tool adapted to engage the internal walls of the base retainer element, comprising:

an elongate and hollow outer shaft that extends within the channel defined by the stacked packing elements;

an elongate inner shaft received within the outer shaft and longitudinally movable relative to the outer shaft; and a grip element positioned at one end of the outer shaft, the grip element having a wing section with a cross-sectional profile that can be selectively contracted and expanded.

12. The assembly of claim 11, further comprising:
a positioning system that releasably maintains the wing section within the base retainer element.

13. The assembly of claim 12 in which the uppermost packing element within the stuffing box is characterized as a box closure element and in which the positioning system comprises:
a plug element coaxially and removably engaged with the box closure element, the plug element having a centrally disposed bore through which the shaft is received; and
a stop element formed on the shaft and engaged with the plug element such that the wing section is maintained within the base retainer element.

14. The assembly of claim 11, further comprising:
a system that positions the shaft of an unloading tool in coaxial alignment with the stuffing box.

15. The assembly of claim 14 in which the platform system that positions the shaft comprises:
a platform element having a centrally disposed bore through which the shaft is closely but clearingly received; and
an elevation element that stably positions the platform element in longitudinally offset relationship to the stuffing box.

16. The assembly of claim 11 in which the stuffing box is characterized by an external flange, and in which footing element comprises:
a plate having a recessed receptacle sized to closely but clearingly receive the external flange.

17. The assembly of claim 16 in which the footing element further comprises:
a releasable locking system that restrains the stuffing box within the receptacle.

18. The assembly of claim 17 in which the plate is characterized by an externally opening socket communicating with the receptacle and in which the locking system comprises:
an adjustable fastener received within the socket and adapted to engage the stuffing box within the receptacle.

19. A kit for unloading a stuffing box loaded with stacked annular packing elements, including and uppermost box closure element and a lowermost base retainer element having internal walls, comprising:
a footing element adapted to releasably engage and maintain the stuffing box in a fixed position;
one or more components that can form an unloading tool adapted to engage the internal walls of the loaded base retainer element, comprising:
an elongate shaft; and
a grip element positionable at one end of the shaft, the grip element having a wing section with a cross-sectional profile that can be selectively contracted and expanded; and
one or more components that can form a positioning system adapted to releasably maintain the wing section within the base retainer element, comprising:
a plug element adapted for coaxial and removable engagement with the loaded box closure element, the plug element having a centrally disposed bore through which the shaft is receivable; and
a stop element formed on the shaft and engageable with the installed plug element such that the wing section is maintained within the base retainer element.

20. The kit of claim 19, further comprising:
one or more components that can form a longitudinally offset platform system that can position the shaft of an unloading tool in coaxial alignment with a stuffing box within the footing element.

21. A kit for unloading a stuffing box loaded with stacked annular packing elements, including a lowermost base retainer element having internal walls, comprising:
a footing element adapted to releasably engage and maintain the stuffing box in a fixed position;
one or more components that can form an unloading tool adapted to engage the internal walls of the loaded base retainer element, comprising:
an elongate shaft; and
a grip element positionable at one end of the shaft, the grip element having a wing section with a cross-sectional profile that can be selectively contracted and expanded; and
one or more components that can form a longitudinally offset platform system that can position the shaft of an unloading tool in coaxial alignment with a stuffing box within the footing element, comprising:
a platform element having a centrally disposed bore through which the shaft may be closely but clearingly received; and
an elevation element adapted to stably position the platform element in longitudinally offset relationship to a stuffing box within the footing element.

22. A kit for unloading a stuffing box loaded with stacked annular packing elements, including a lowermost base retainer element having internal walls, comprising:
a footing element adapted to releasably engage and maintain the stuffing box in a fixed position; and
one or more components that can form an unloading tool adapted to engage the internal walls of the loaded base retainer element, comprising:
an elongate and hollow outer shaft;
an elongate inner shaft receivable within the outer shaft and longitudinally movable relative to the outer shaft;
a grip element positionable at one end of the outer shaft, the grip element having a wing section with a cross-sectional profile that can be selectively contracted and expanded, the wing section formed from a plurality of uniformly spaced wedge members arrayed around the grip element's longitudinal axis, each wedge member having an outer side surface conformably engageable with the internal walls of the base retainer element and a tapered inner side surface; and
a core element supported at one end of the inner shaft, the core element having at least one tapered outer side surface that can slidingly engage the tapered inner side surfaces of the wedge members forming the wing section.

23. A kit for unloading a stuffing box having an external flange and loaded with stacked annular packing elements, including a lowermost base retainer element having internal walls, comprising:
a footing element adapted to releasably engage and maintain the stuffing box in a fixed position, comprising:
a plate having a recessed receptacle sized to closely but clearingly receive the external flange; and
one or more components that can form an unloading tool adapted to engage the internal walls of the loaded base retainer element, comprising:
an elongate shaft; and
a grip element positionable at one end of the shaft, the grip element having a wing section with a cross-sectional profile that can be selectively contracted and expanded.

24. The kit of claim 23 in which the footing element further comprises:

a releasable locking system adapted to restrain the stuffing box within in the receptacle.

25. The kit of claim 24 in which the plate is characterized by an externally opening socket communicating with the receptacle and in which the locking system comprises:

an adjustable fastener receivable within the socket and adapted to engage the stuffing box within the receptacle.

26. An assembly comprising:

a stuffing box loaded with stacked annular packing elements, including and uppermost box closure element and a lowermost base retainer element having internal walls, the stacked packing elements defining an internal channel;

a footing element that releasably engages and maintains the stuffing box in a fixed position;

an unloading tool adapted to engage the internal walls of the base retainer element, comprising:

an elongate shaft that extends within the channel defined by the stacked packing elements; and a grip element positioned at one end of the shaft, the grip element having a wing section with a cross-sectional profile that can be selectively contracted and expanded; and a positioning system that releasably maintains the wing section within the base retainer element, comprising:

a plug element coaxially and removably engaged with the box closure element, the plug element having a centrally disposed bore through which the shaft is received; and a stop element formed on the shaft and engaged with the plug element such that the wing section is maintained within the base retainer element.

27. An assembly comprising:

a stuffing box loaded with stacked annular packing elements, including a lowermost base retainer element having internal walls, the stacked packing elements defining an internal channel;

a footing element that releasably engages and maintains the stuffing box in a fixed position;

an unloading tool adapted to engage the internal walls of the base retainer element, comprising:

an elongate shaft that extends within the channel defined by the stacked packing elements; and a grip element positioned at one end of the shaft, the grip element having a wing section with a cross-sectional profile that can be selectively contracted and expanded; and a longitudinally offset platform system that positions the shaft of an unloading tool in coaxial alignment with the stuffing box, comprising:

a platform element having a centrally disposed bore through which the shaft is closely but clearingly received; and an elevation element that stably positions the platform element in longitudinally offset relationship to the stuffing box.

28. An assembly comprising:

a stuffing box loaded with stacked annular packing elements, including a lowermost base retainer element having internal walls, the stacked packing elements defining an internal channel;

a footing element that releasably engages and maintains the stuffing box in a fixed position; and an unloading tool adapted to engage the internal walls of the base retainer element, comprising:

an elongate and hollow outer shaft that extends within the channel defined by the stacked packing elements; and a grip element positioned at one end of the outer shaft, the grip element having a wing section with a cross-sectional profile that can be selectively contracted and expanded, the wing section formed from a plurality of uniformly spaced wedge members arrayed around the grip element's longitudinal axis, each wedge member having an outer side surface conformably engageable with the internal walls of the base retainer element and a tapered inner side surface; and a core element supported at one end of the inner shaft, the core element having at least one tapered outer side surface that slidingly engages the tapered inner side surfaces of the wedge members forming the wing section.

29. An assembly comprising:

a stuffing box having an external flange and loaded with stacked annular packing elements, including a lowermost base retainer element having internal walls, the stacked packing elements defining an internal channel;

a footing element that releasably engages and maintains the stuffing box in a fixed position, comprising:

a plate having a recessed receptacle sized to closely but clearingly receive the external flange; and an unloading tool adapted to engage the internal walls of the base retainer element, comprising:

an elongate shaft that extends within the channel defined by the stacked packing elements; and a grip element positioned at one end of the shaft, the grip element having a wing section with a cross-sectional profile that can be selectively contracted and expanded.

30. The assembly of claim 29 in which the footing element further comprises:

a releasable locking system that restrains the stuffing box within the receptacle.

31. The assembly of claim 30 in which the plate is characterized by an externally opening socket communicating with the receptacle and in which the locking system comprises:

an adjustable fastener received within the socket and adapted to engage the stuffing box within the receptacle.

* * * * *